US008302641B2

(12) United States Patent
Nelson

(10) Patent No.: US 8,302,641 B2
(45) Date of Patent: Nov. 6, 2012

(54) HANDBAG ARTICLES

(75) Inventor: Judith A. Nelson, Naples, FL (US)

(73) Assignee: Judith A. Nelson, Highlands Ranch, CO (US)

( * ) Notice: Subject to any disclaimer, the term of this patent is extended or adjusted under 35 U.S.C. 154(b) by 564 days.

(21) Appl. No.: 12/589,535

(22) Filed: May 13, 2009

(65) Prior Publication Data

US 2011/0005646 A1 Jan. 13, 2011

Related U.S. Application Data

(63) Continuation of application No. 29/306,001, filed on Mar. 31, 2008, now Pat. No. Des. 599,545, and a continuation of application No. 29/306,002, filed on Mar. 31, 2008, now Pat. No. Des. 596,851, and a continuation of application No. 29/306,003, filed on Mar. 31, 2008, now Pat. No. Des. 596,852, and a continuation of application No. 29/306,004, filed on Mar. 31, 2008, now Pat. No. Des. 596,853, and a continuation of application No. 29/306,007, filed on Mar. 31, 2008, now Pat. No. Des. 596,844, and a continuation of application No. 29/306,006, filed on Mar. 31, 2008, now Pat. No. Des. 596,854, and a continuation of application No. 29/306,008, filed on Mar. 31, 2008, now Pat. No. Des. 596,845, and a continuation of application No. 29/306,009, filed on Mar. 31, 2008, now Pat. No. Des. 596,846, and a continuation of application No. 29/306,011, filed on Mar. 31, 2008, now Pat. No. Des. 596,848, and a continuation of application No. 29/306,010, filed on Mar. 31, 2008, now Pat. No. Des. 596,847.

(51) Int. Cl.
*A45C 13/30* (2006.01)

(52) U.S. Cl. ..... 150/103; 150/106; 150/107; 150/127; 150/128; 150/129; 383/13; 383/27

(58) Field of Classification Search ..... 150/103, 150/104, 106, 107–110, 127–130; 383/121–125, 383/2, 13, 27

See application file for complete search history.

(56) References Cited

U.S. PATENT DOCUMENTS

| | | | | |
|---|---|---|---|---|
| 2,325,853 | A * | 8/1943 | Harlem | 383/33 |
| 2,746,582 | A * | 5/1956 | Cart | 190/115 |
| D426,060 | S * | 6/2000 | Chapelier | D3/303 |
| D452,074 | S * | 12/2001 | Guyon | D3/246 |
| 6,640,856 | B1 * | 11/2003 | Tucker | 150/130 |
| 6,715,594 | B2 * | 4/2004 | Milionta et al. | 190/110 |
| D547,945 | S * | 8/2007 | Gonzalez | D3/243 |
| 7,926,525 | B2 * | 4/2011 | Vaccarella | 150/108 |
| 2007/0163689 | A1 * | 7/2007 | Pace et al. | 150/105 |
| 2009/0101254 | A1 * | 4/2009 | Vaccarella | 150/108 |

* cited by examiner

*Primary Examiner* — Tri Mai

(57) ABSTRACT

A reversible handbag capable of taking a variety of different shapes and configurations having a front side, a back side, and a bottom side, two side seams formed by joining the boundaries of the front side with the boundaries of the back side. The bottoms of the front side and back side are joined to the outer perimeter of the bottom side leaving an open periphery at the top of the handbag. The side seams each have an aperture located near their top edges and the front back sides each have two columns of two or more apertures. The open periphery can be folded inward or outward to create several different configurations of the handbag and the apertures on the side seams and front and back sides are capable of receiving clasps or other fasteners from straps in order to provide handles, carrying straps, and the like for the various configurations.

13 Claims, 51 Drawing Sheets

HANDBAG ARTICLES

RELATED APPLICATIONS

This application is a continuation of application Ser. No. 29/306,001, now U.S. Pat. D599, 545; application Ser. No. 29/306,002, now U.S. Pat. D596,851; application Ser. No. 29/306,003, now U.S. Pat. D596,852; application Ser. No. 29/306,004, now U.S. Pat. D596,853; application Ser. No. 29/306,007, now U.S. Pat. D596,844; application Ser. No. 29/306,006, now U.S. Pat. D596,354; application Ser. No. 29/306,008, now U.S. Pat. D596,845; application Ser. No. 29/306,009, now U.S. Pat. D596,846; application Ser. No. 29/306,011, now U.S. Pat. D596,848; application Ser. No. 29/306,010, now U.S. Pat. D596,847, all of which were filed on Mar. 31, 2008. Each of the foregoing is hereby incorporated by reference.

BACKGROUND OF THE INVENTION

Field of Invention

The present invention generally relates to the field of handbags.

SUMMARY

The present invention concerns a modular, interchangeable handbag that is capable of being configured in a variety of ways, to permit a user to change the look and feel of the handbag as desired. It is an object of the present invention to provide a reversible handbag having two sides comprised of different materials. It is a further object of the present invention to provide a reversible handbag having a variety of grommets capable of retaining handles so that the handbag can be configured in different ways. It is a further object of the present invention to provide a handbag that is capable of retaining a smaller inner handbag that can be used for additional storage. It is a further object of the present invention to provide a modular, interchangeable handbag having configurations that are practical as well as aesthetically pleasing and fashionable. It is a further object of the present invention to provide a modular, interchangeable handbag that is easy to operate so that a user can readily create different looks and styles. These and other objects of the present invention will become readily apparent to those skilled in the art upon a review of the following detailed description and figures.

BRIEF DESCRIPTION OF THE DRAWINGS

The nature, objects, and advantages of the invention will become more apparent to those skilled in the art after considering the following detailed description in connection with the accompanying drawings, wherein.

DETAILED DESCRIPTION OF THE EMBODIMENTS

Figure 1:
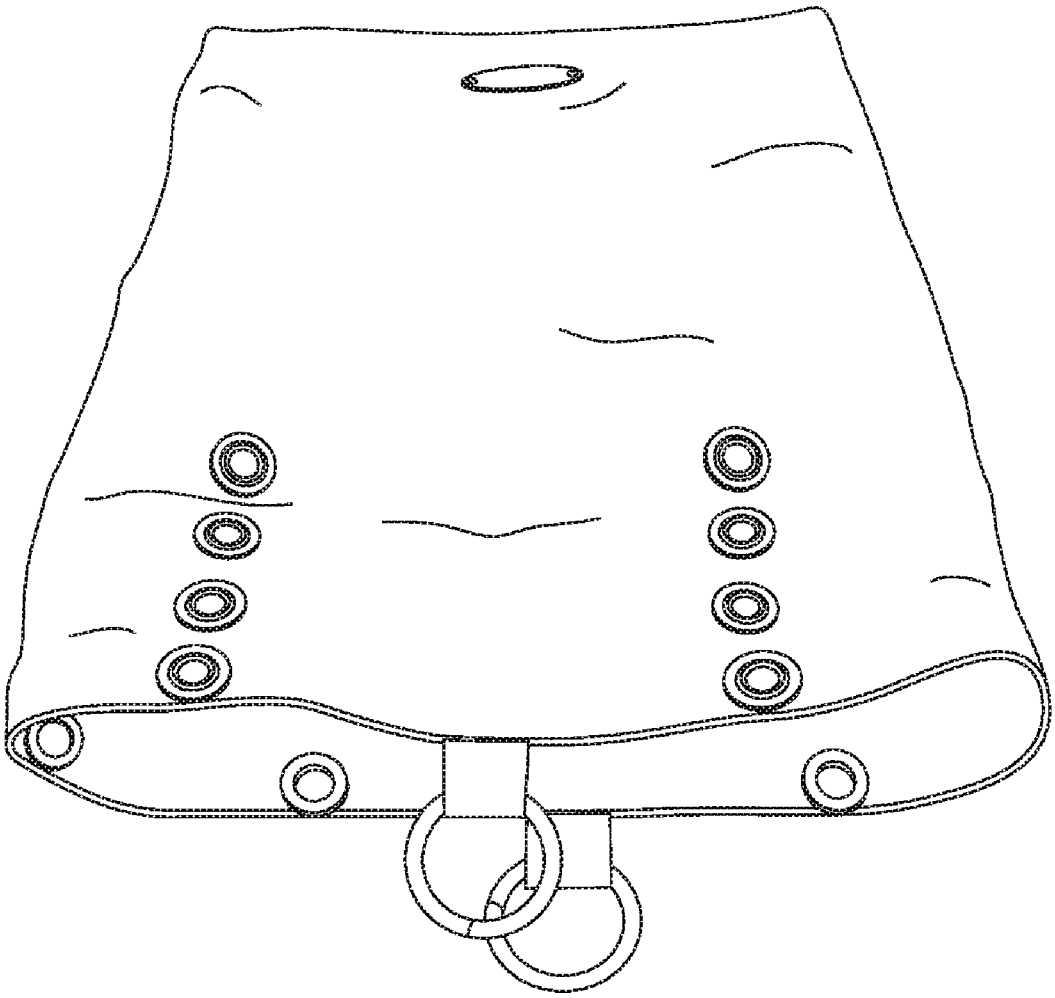
FIG. 1 is a front aspect view of one embodiment of the bag of the present invention, showing the fabric side.
Figure 2:
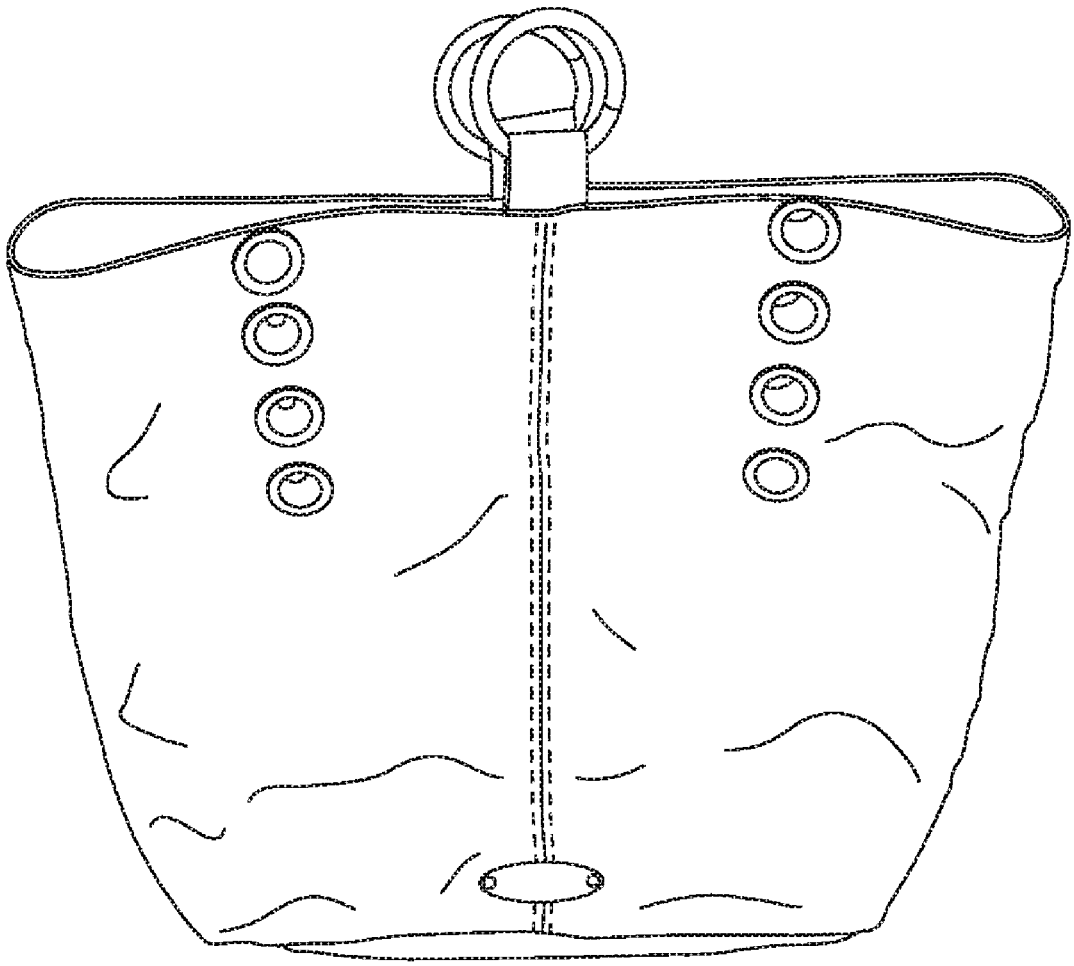
FIG. 2 is a front view of the bag in FIG. 1, showing the leather side.

Pertaining to the present invention, this original handbag design allows a user the ability to dramatically change the look of a single handbag by completely reversing the handbag revealing one, both or a combination of both the interior and exterior different fabrics, tapestries, or leathers, and in addition, alter the look of the bag by folding outwardly (cuffing) the interior side (of the moment) of the bag over the exterior (of the moment) at various levels, that match the spacing of the installed grommets, eyelets, (or other similar devices), for detachable handle attachment.

In one embodiment, a user may completely reverse the handbag to reveals one, both or a combination of both the interior and exterior different fabrics, tapestries, or leathers, and in addition, alter the look of the bag by folding outwardly (cuffing) the interior side (of the moment) of the bag over the exterior (of the moment) at various levels, that match the spacing of the installed grommets, eyelets, (or other similar devices), for handle attachment. FIGS. 1-51 show various embodiments of the inventive subject matter including several various configurations of the handbag and of the detachable handles.

In several of the embodiments, the handbag design allows the user to fold the top of the bag inwardly to reveal only the exterior (of the moment), creating either an entirely different look depending upon which fabric, tapestry or leather is revealed when used as the exterior of the bag. In these embodiments, the interior and exterior fabrics or leathers are sewn together back to back
\with finished interior seams on both sides to create the bag.

Further, two long padded matching leather handles each have two metal snap hook clips (or similar spring-loaded attachment devices) attached to the ends for easy removal and reattachment to the bag at any level or transformation of the bag. These embodiments can lack a dedicated "inside" (normally defined as a lining), nor "outside" of the bag (the side that, on traditional bags, is the one that is always the exterior.)

As shown in the Figures, the embodiments have the ability to provide the user with a handbag having multiple looks (in some embodiments at least 17 transformations) within each single bag, all of the same basic design, by folding the bag inwards or outwards, reversing the bag, attaching the specially designed handles to the installed grommets, eyelets (or other similar devices) in several ways and levels, (such as a tote, hobo, backpack, messenger, evening bag, cuffed bag), and even using the bag without the handles as a "clutch" bag.

In these embodiments, the design of this bag does not require the user to attach or detach different "sides", "skins", or panels to the structure of the bag. This feature allows the wearer or user to change the look of the bag (in additional to the utilitarian function of the bag) without carrying several extra parts or panels. Additional interior configurations may also be added or used, or removed as desired by the user.

In some embodiments, the bag is designed with, but not limited to, eight grommets, eyelets (or other similar devices) specifically placed in two columns of, but not limited to, four on both the front and back sides of the bag (FIG. 1) showing full fabric side, (FIG. 2) showing full leather side, spaced to accommodate a natural width for attachment of the handbag handles with each end of the removable handle clipped into the top two exposed grommets, eyelets (or similar devices) on each corresponding side, depending on which grommets, eyelets (on similar devices) are exposed, based on the level of folding or unfolding of the bag.

Two additional side grommets, eyelets (or similar devices) are installed, one at the top edge of each side seam of the bag (FIG. 3) fabric side view, (FIG. 4) leather side view, for additional variety of style by attaching a single handle to enable additional changes in the look and style of the handbag.

Different finished hardware colors are used such as but not limited to, nickel, antique brass, and bright brass (or gold-toned), including the grommets, handle clips, rings, purse feet, tassel top, key rings, and other hardware that may be used on either side of the bag.

As the bag is folded inwardly or outwardly the bag becomes either smaller or larger depending upon what look the user desires, and the unique spacing of the grommets, eyelets (or similar devices) allows the handles to be re-attached at different levels of the bag where folded.

The interior of the handbag becomes the exterior when reversed; or if the bag is folded inwards or outwards the look of the bag changes due to revealing portions of the interior or exterior of the bag in contrast with each other.

In many instances, one side of the bag is fine luxury leather in a variety of colors and patterns, and the opposite side is a fabric or tapestry that is specifically selected to complement the color of the leather.

One side of the bag is designed with a unique "box bottom" with, but not limited to, four metal feet attached to the bottom (FIG. 5) leather side view of bottom, and the opposite side (when fully reversed) is a completely different "rounded" bottom design look (FIG. 6) fabric side view of bottom, with the bottom corners of the square bag drawn up (FIG. 7) and held with leather tabs (FIG. 8) into metal rings (FIG. 9) to the side of the bag.

Figure 6:
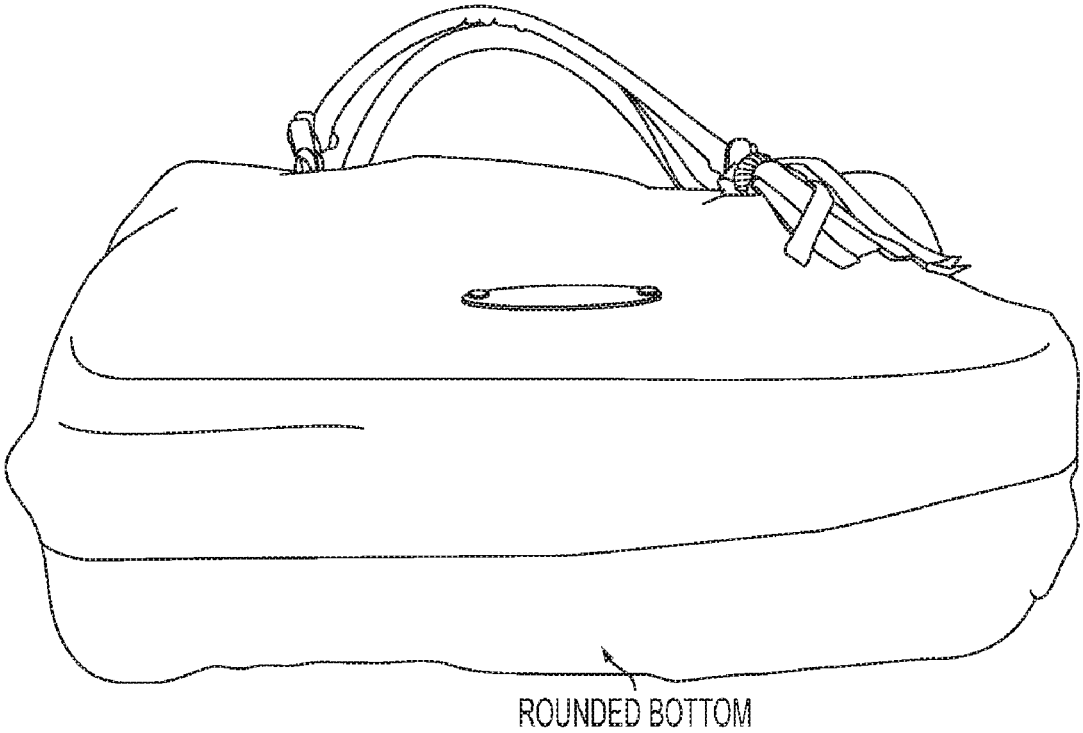
FIG. 6 is a bottom view of the bag in FIG. 1, showing the fabric side.

Another feature of the embodiments of the handbag is the two different handbag bottoms which dramatically change the look and style of the bag depending on which side has been revealed. (FIG. 5) and (FIG. 6). In these embodiments, the handbag will become smaller or larger depending upon how much is folded or unfolded. The special fabrics and or leathers chosen for handbag are designed to dramatically change the appearance and look.

Figure 10:
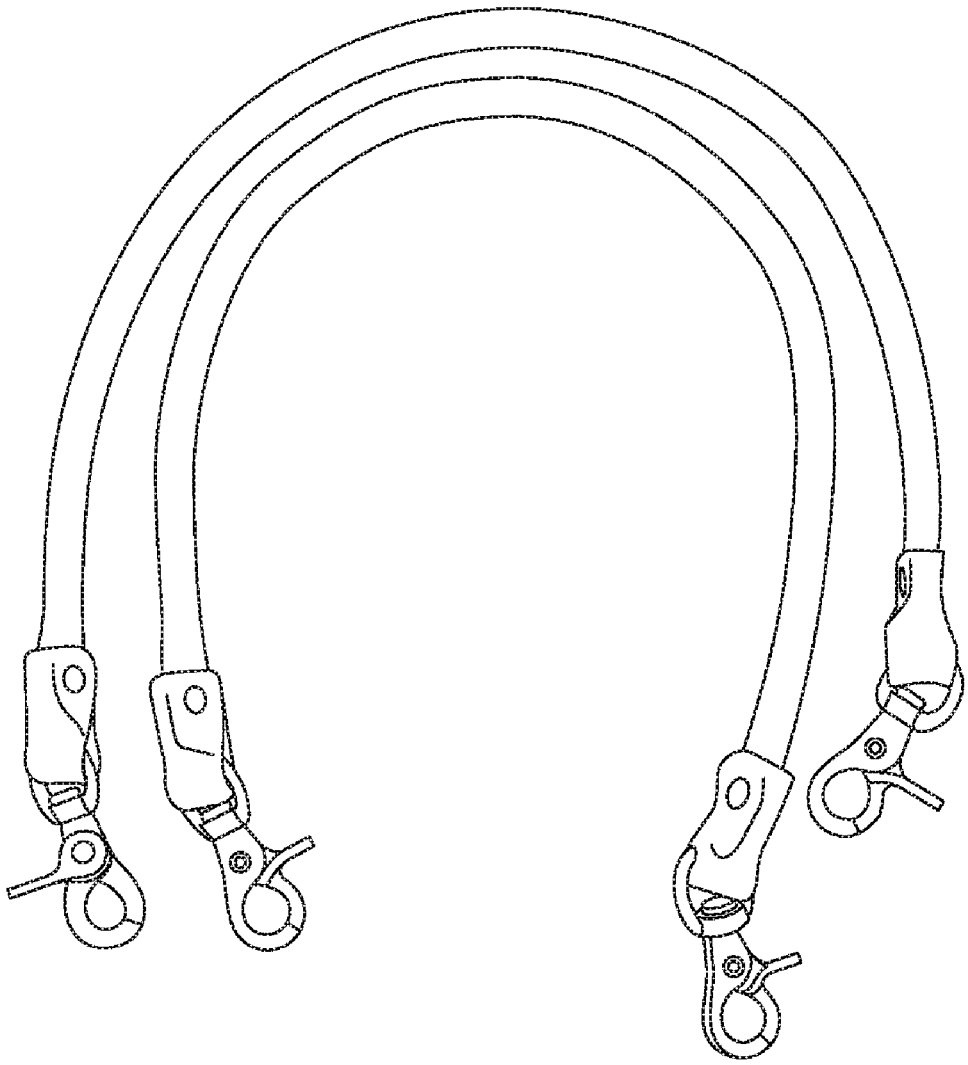
FIG. 10 is a front view of exemplary handles that may be attached to the bag of the present invention.
Figure 11:
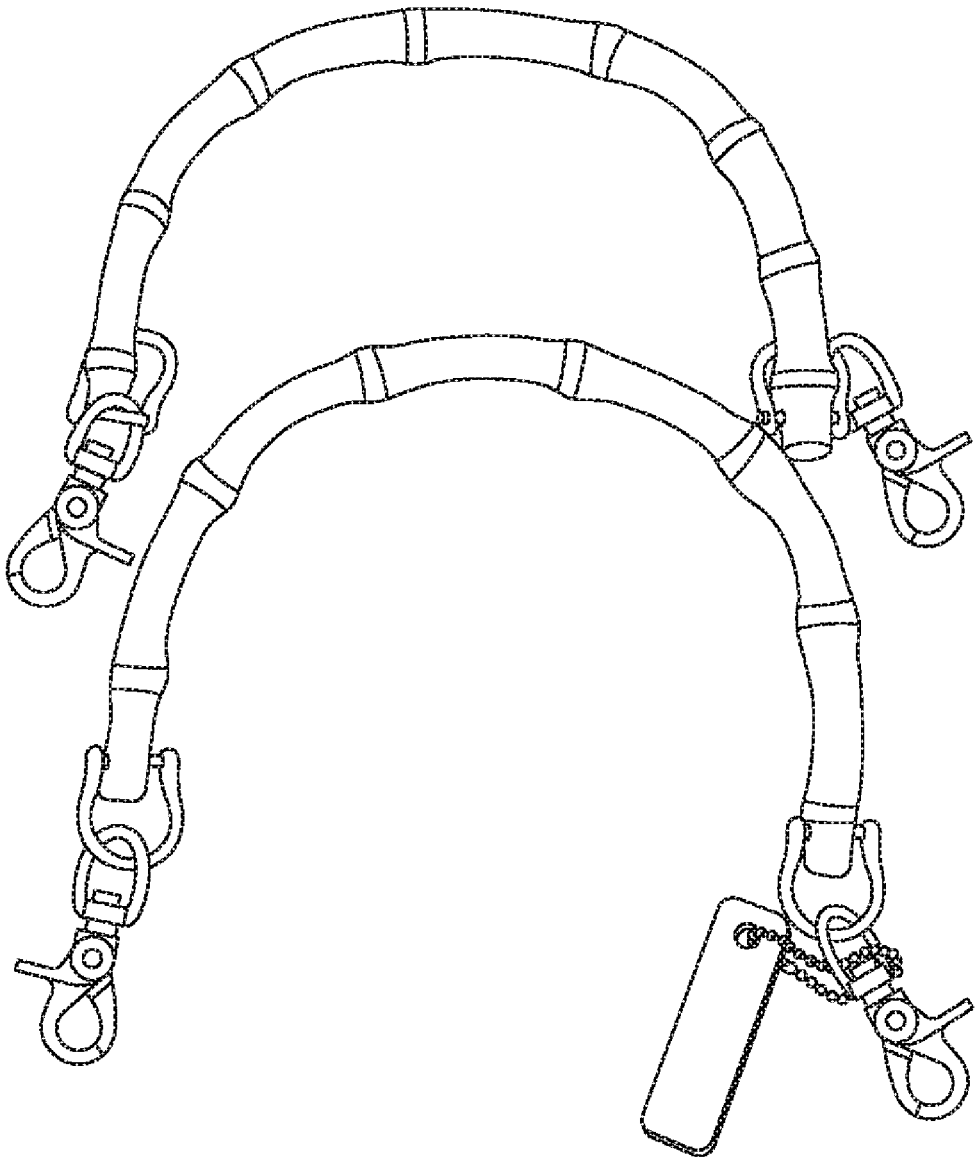
FIG. 11 is a front view of exemplary handles that may be attached to the bag of the present invention.
Figure 12:
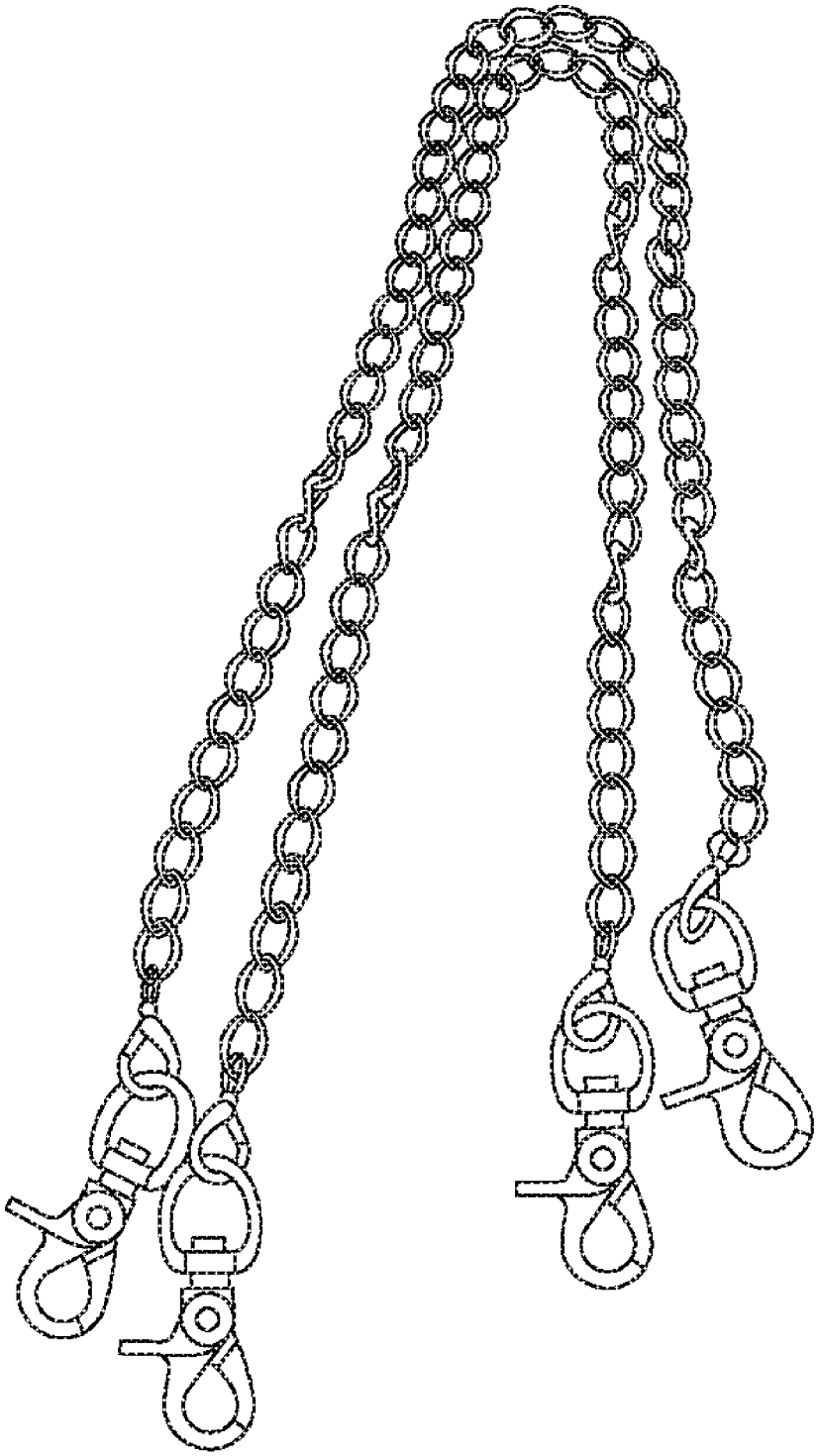
FIG. 12 is a front view of exemplary handles that may be attached to the bag of the present invention.
Figure 13:
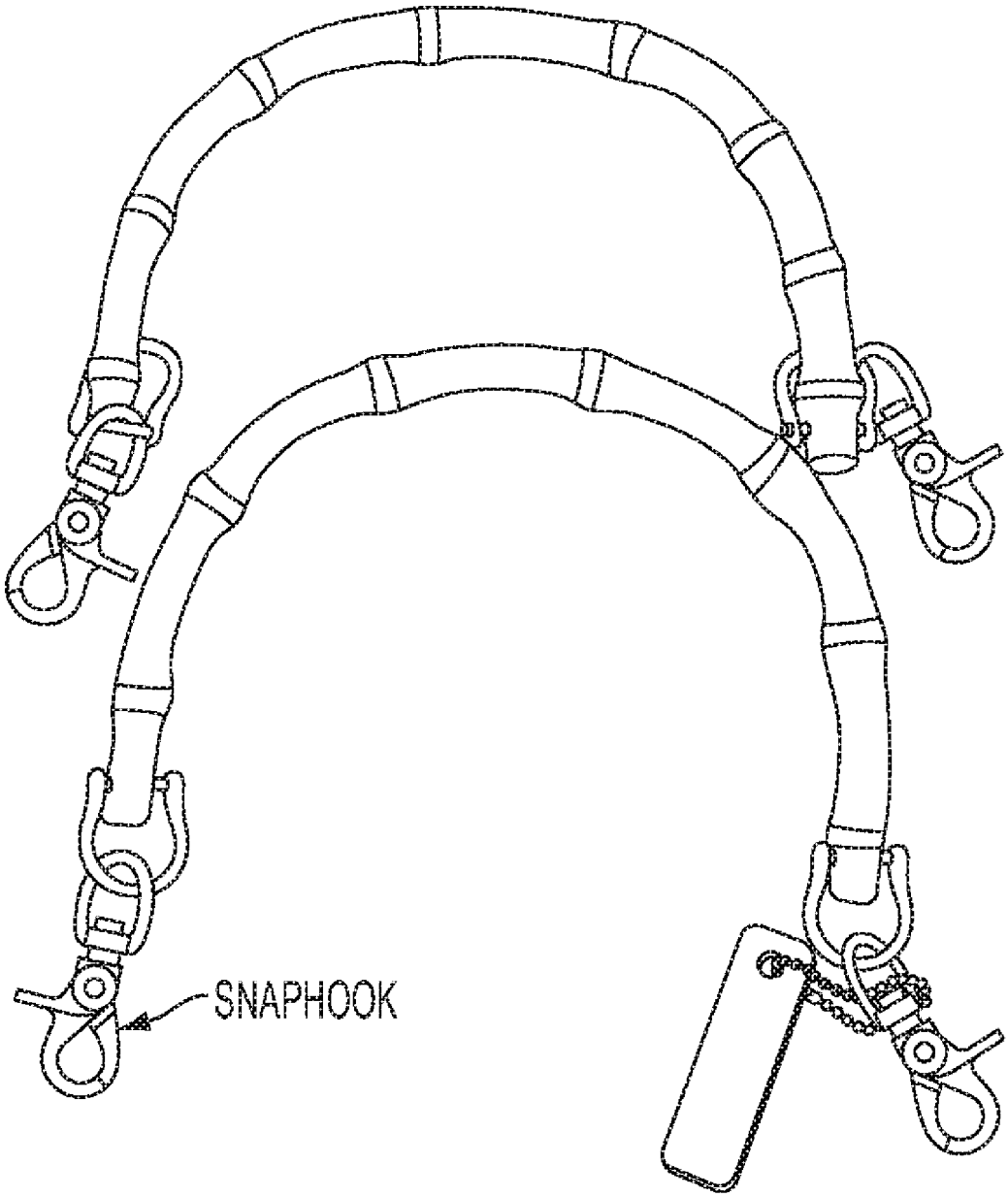
FIG. 13 is a front view of the handles shown in FIG. 11, showing additional detail.
Figure 14:
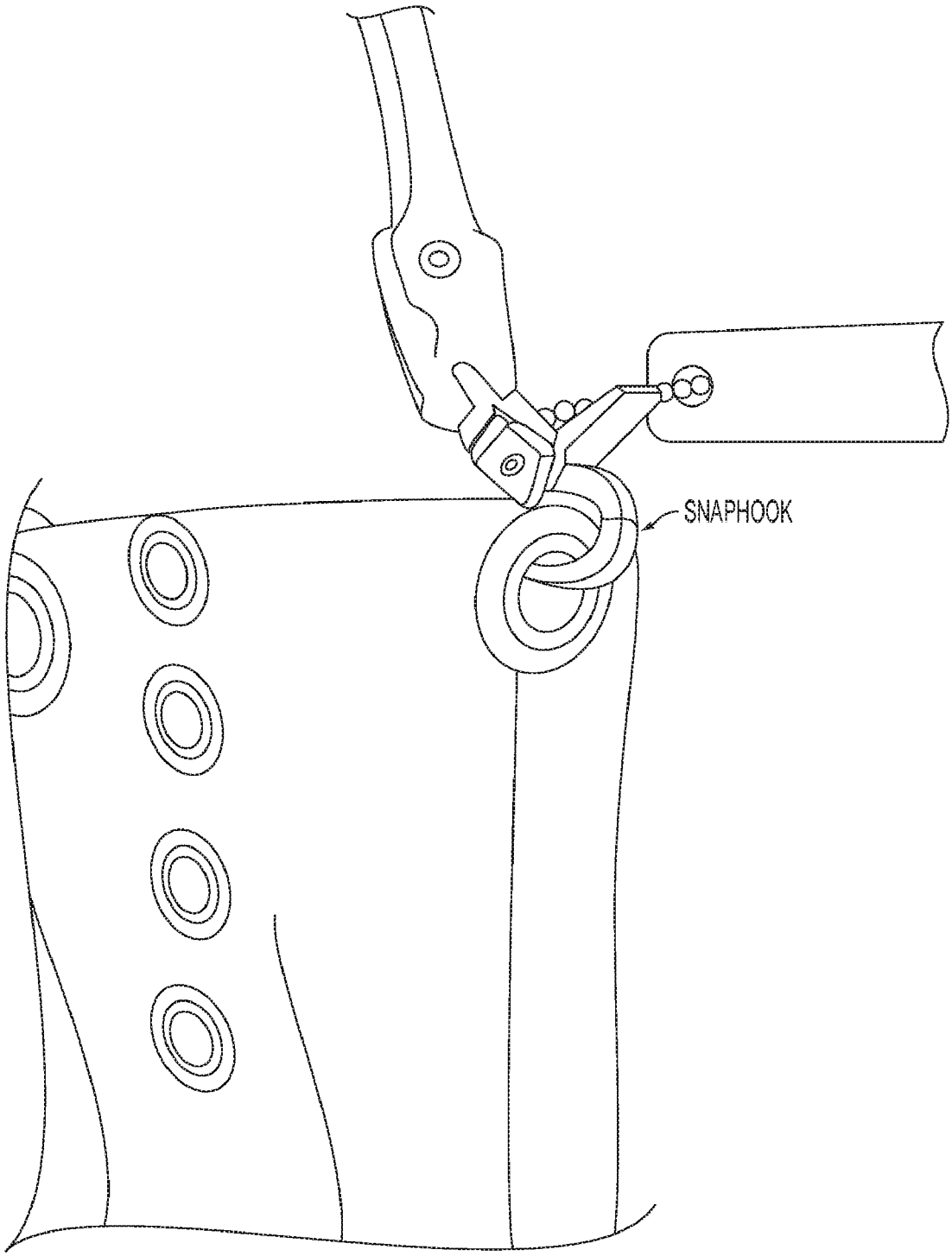
FIG. 14 is a close-up view of the handbag in FIG. 1, with a handle attached by a snaphook.
Figure 15:
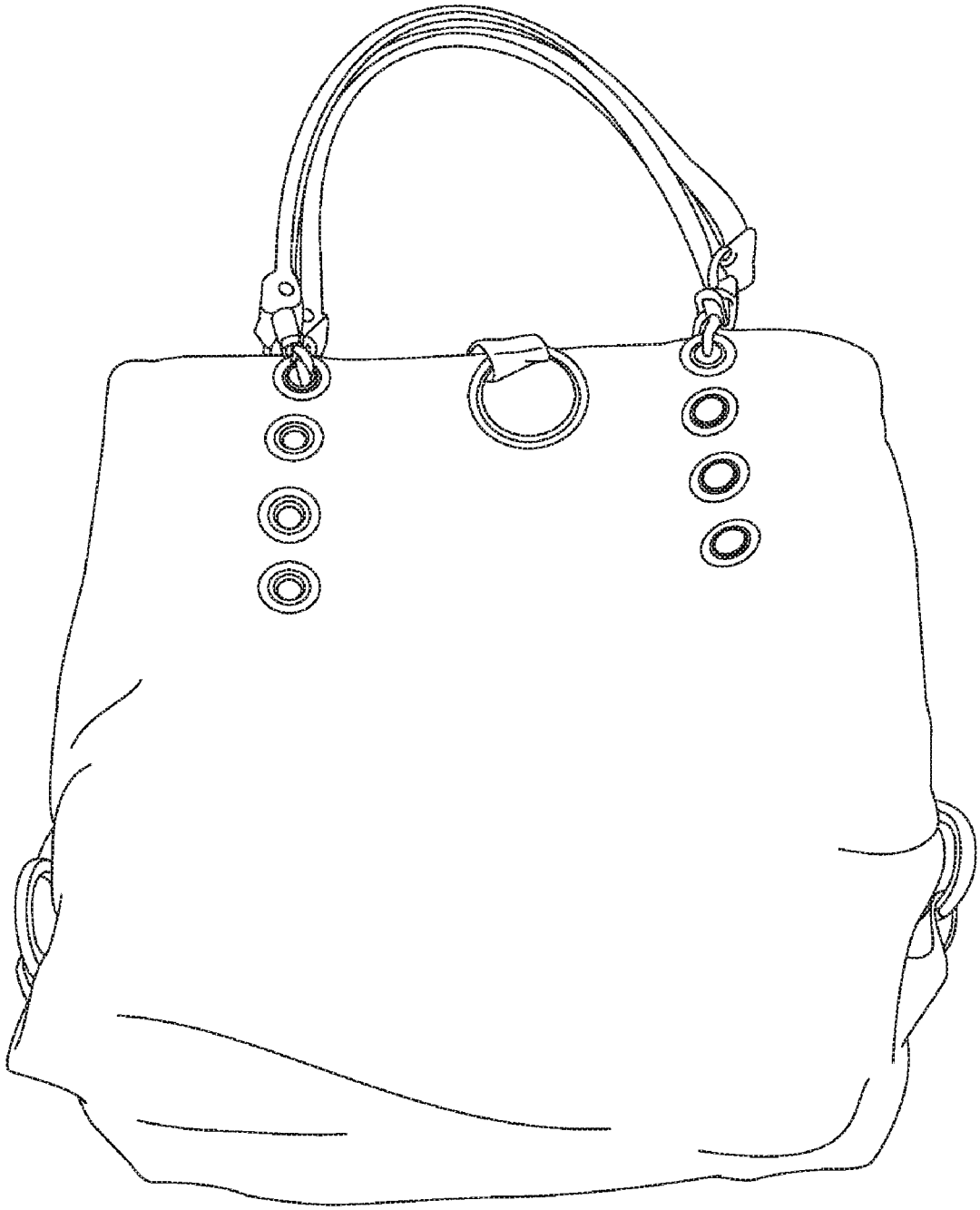
FIG. 15 is a front view of a "tote" bag configuration of the bag in FIG. 1, showing the fabric side.
Figure 16:
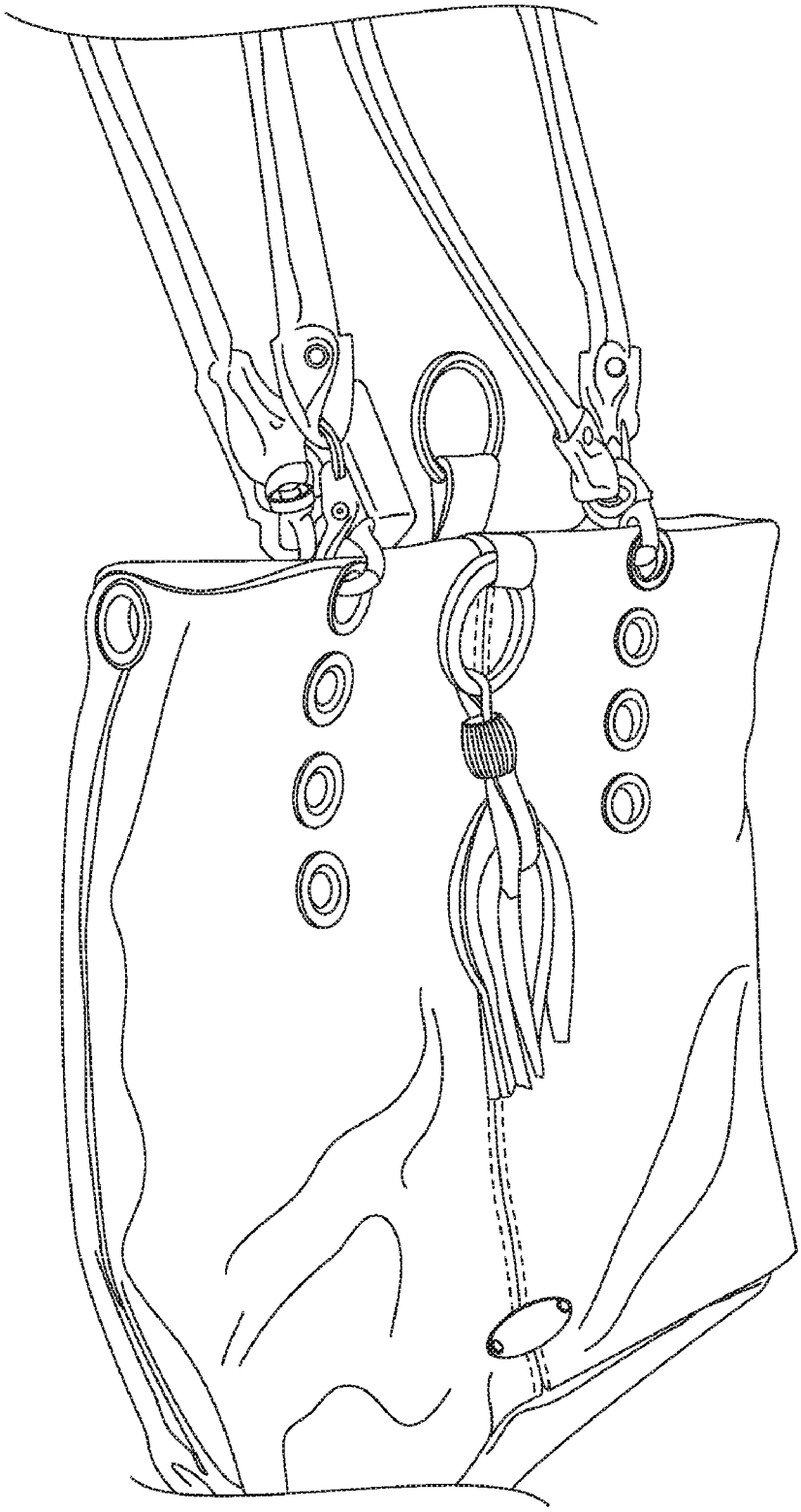
FIG. 16 is a side view of a "tote" bag configuration of the bag in FIG. 1, showing the leather side.
Figure 17:
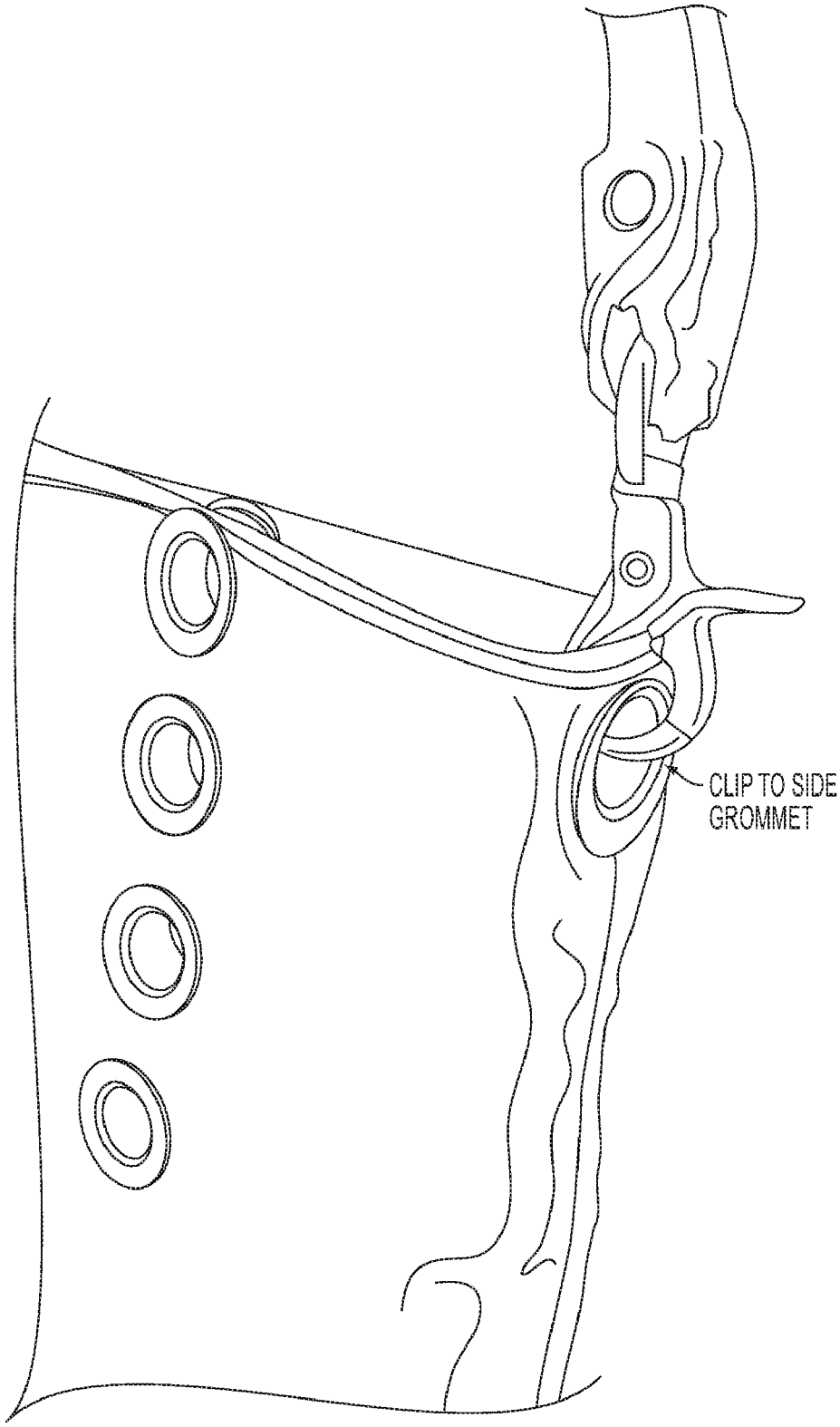
FIG. 17 is a close-up view of the handbag in FIG. 1, with a handle attached by a snaphook.
Figure 18:
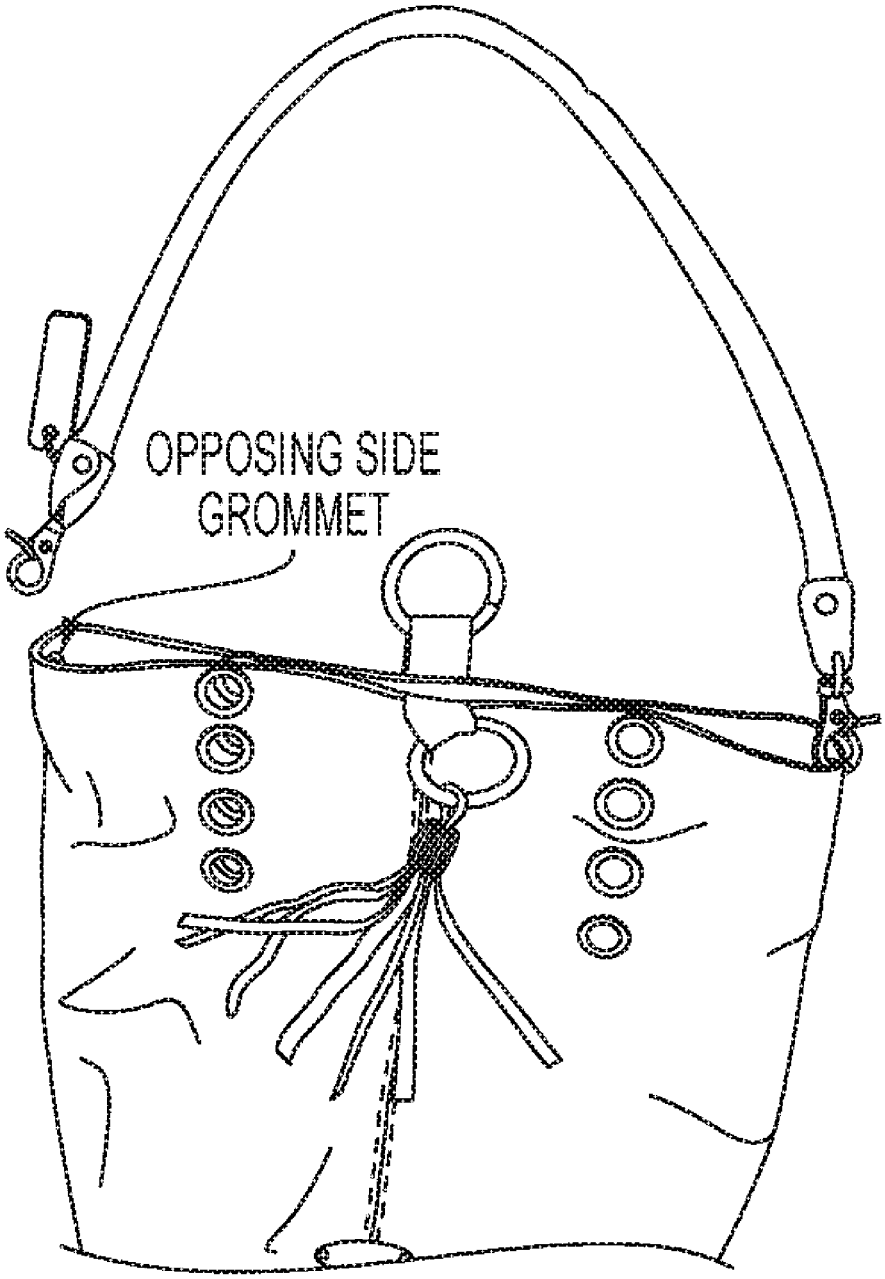
FIG. 18 is a side view of the handbag in FIG. 1, with a handle attached to opposing grommets by snaphooks.

Several types of handles may be used with this bag including but not limited to, two long matching leather handles FIG. 10), two curved bamboo handles (FIG. 11), two metal chain handles (FIG. 12), or other optional stylized handles; and each have a snap hook (or similar spring-loaded device) attached to each end (FIG. 13) for easy removal and attachment to the grommets, eyelets (or similar devices) (FIG. 14). Two matching leather handles are included with the bag and provide not only an elegant design and look, but also may be used for several of the transitions, either together or one at a time, depending on the transition chosen.

With the bag in the fully extended form, the user may clip the two leather handles to the very top of the columned grommets, eyelets (or similar devices), and form what is usually referred to as a "tote" bag look (FIG. 15) front view fabric, and (FIG. 16) tote leather view.

These embodiments only describe a few of the many various looks the user may develop by clipping one or two handles to the specifically designed and located grommets, eyelets (or similar devices) to fashion different types of bags and looks.

The bag is designed to provide material, texture and contrast with one side usually leather, and the opposite side is usually fabric, tapestry, or faux fur. Therefore, the design and placement of the type of fabric, leather or tapestry used is an integral feature of the bag that dramatically impacts and provides uniquely different styles.

Figure 19:
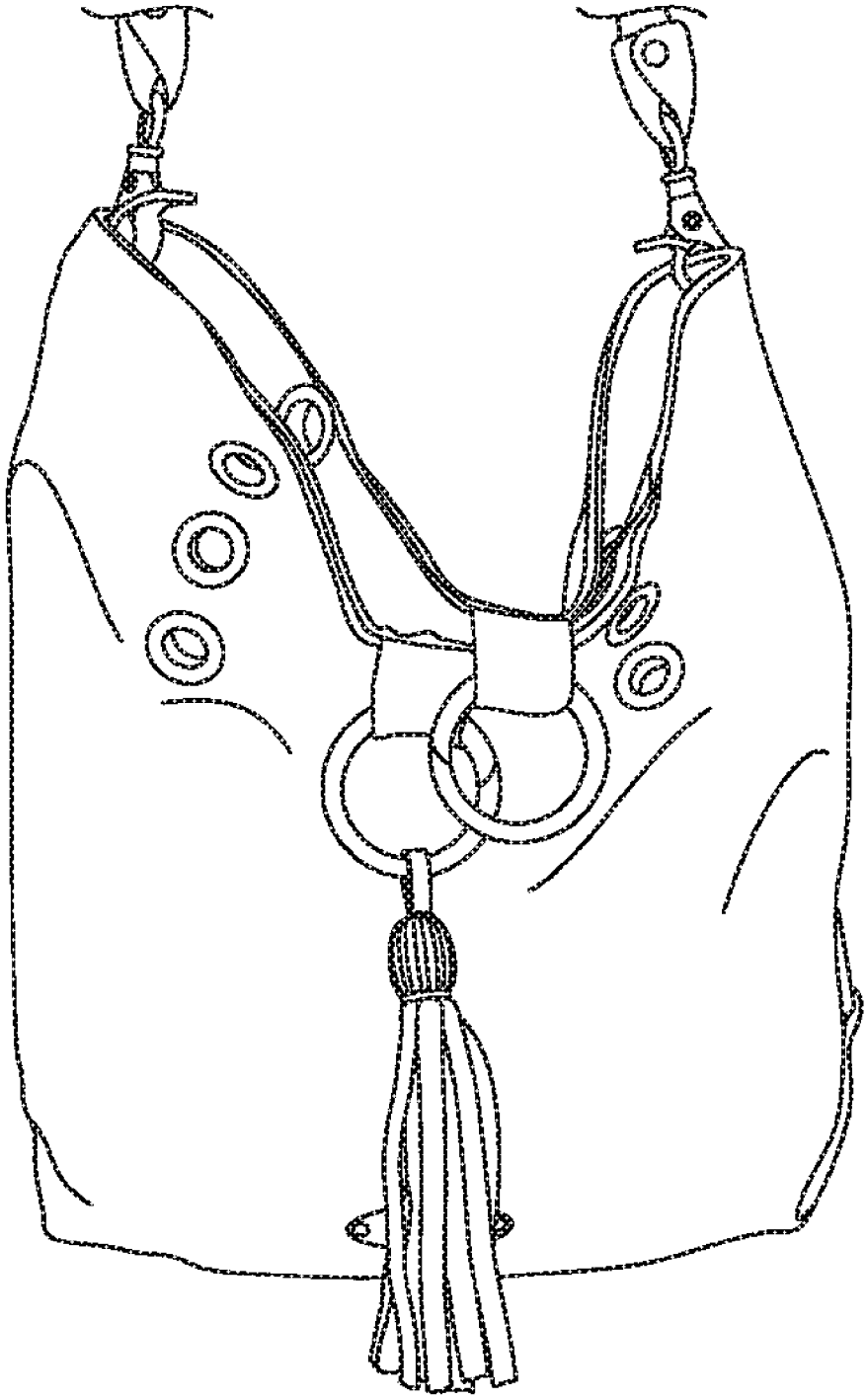
FIG. 19 is a front view of a "hobo" bag configuration of the bag in FIG. 1, showing the fabric side.
Figure 20:
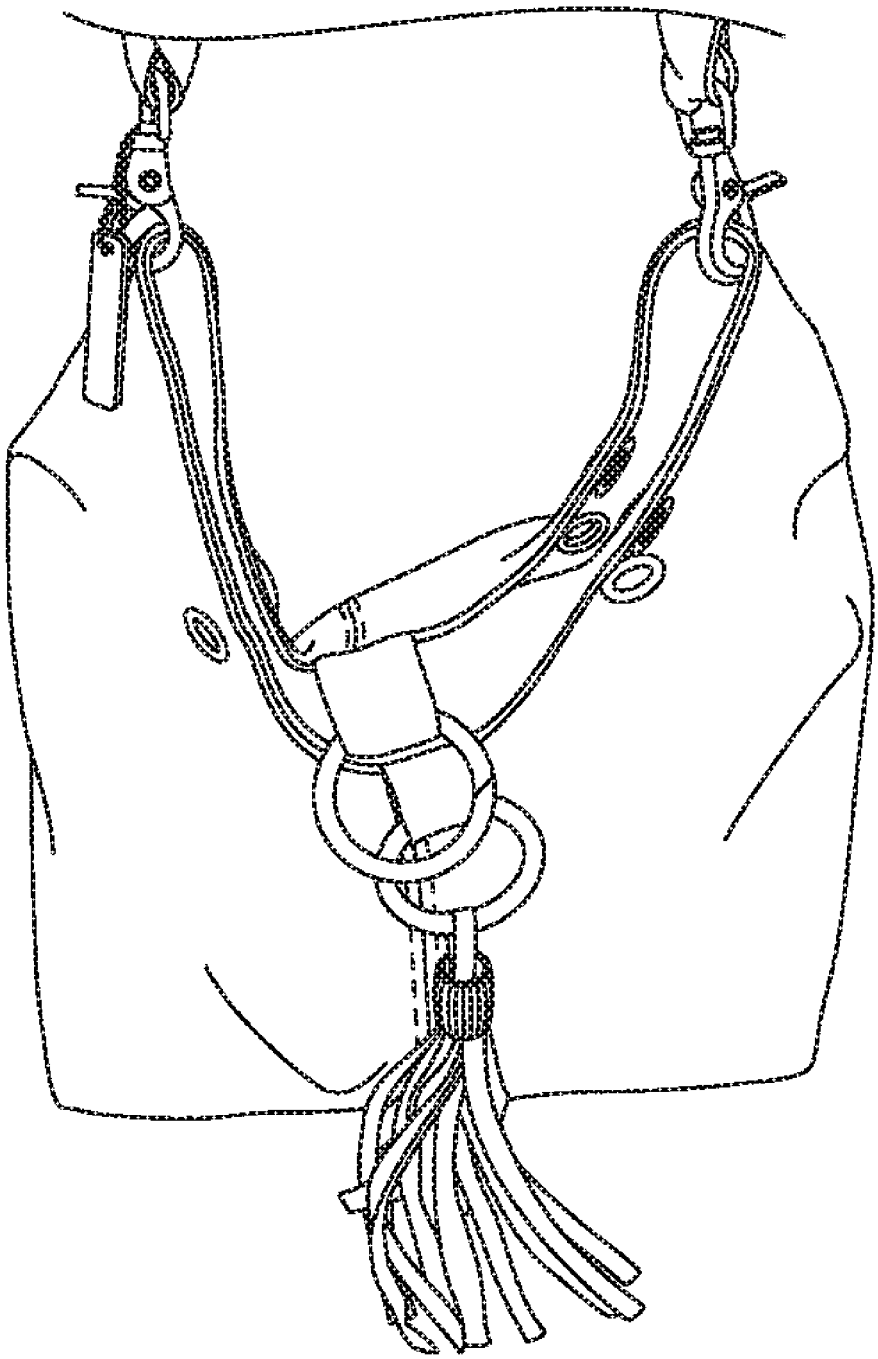
FIG. 20 is a front view of a "hobo" bag configuration of the bag in FIG. 1, showing the leather side.
Figure 21:
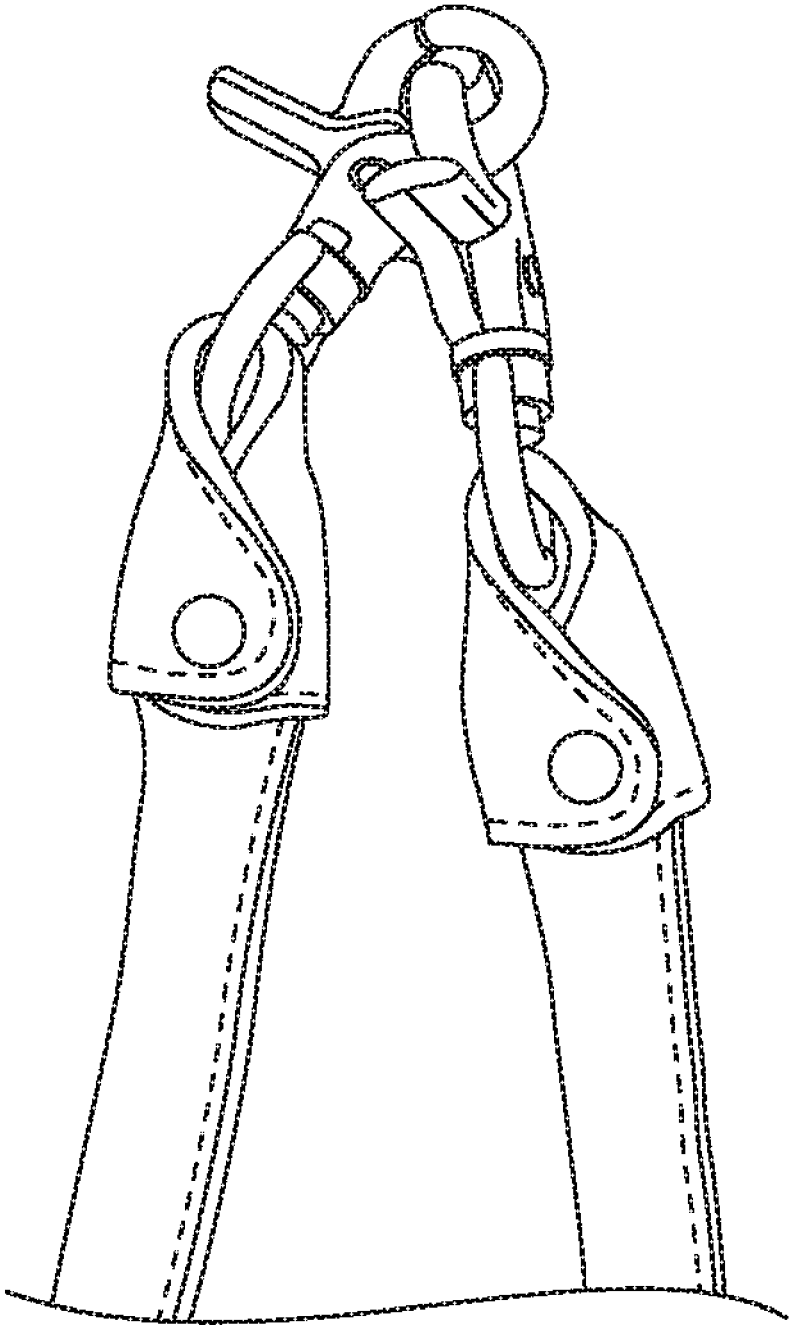
FIG. 21 is a front view showing interlocking handles.

In the tote position the user may clip only one handle end to one side edge grommet, eyelet (or similar device) (FIG. 17) and the other end to the opposing side edge grommet, eyelet (or similar device) (FIG. 18) now instantly providing a "hobo" bag look (FIG. 19) fabric view. The same is true if the user were to fully reverse the bag to the opposite side and attach the handles at the same position, revealing a completely different fabric or leather look (FIG. 20 leather view).

Figure 22:
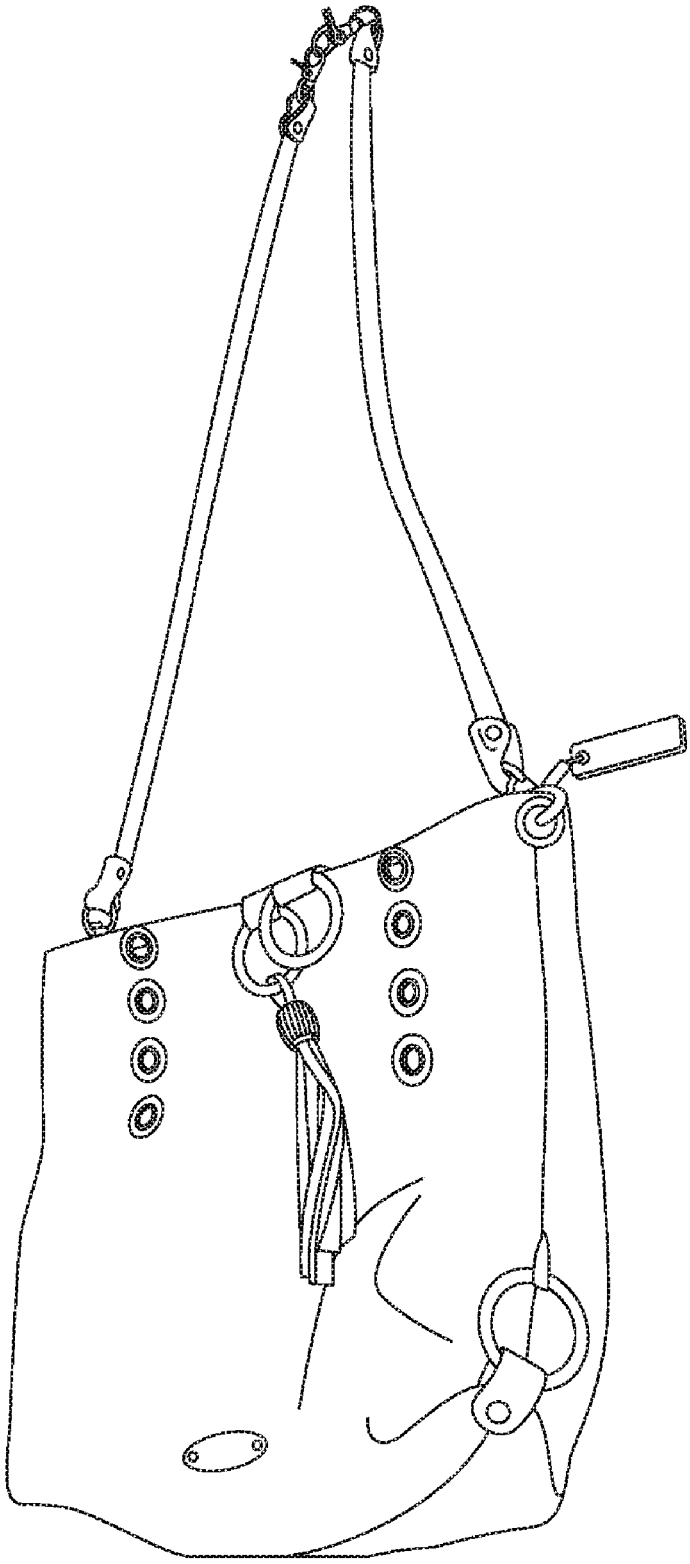
FIG. 22 is a front view of a "messenger" bag configuration of the bag in FIG. 1, showing the fabric side.
Figure 23:
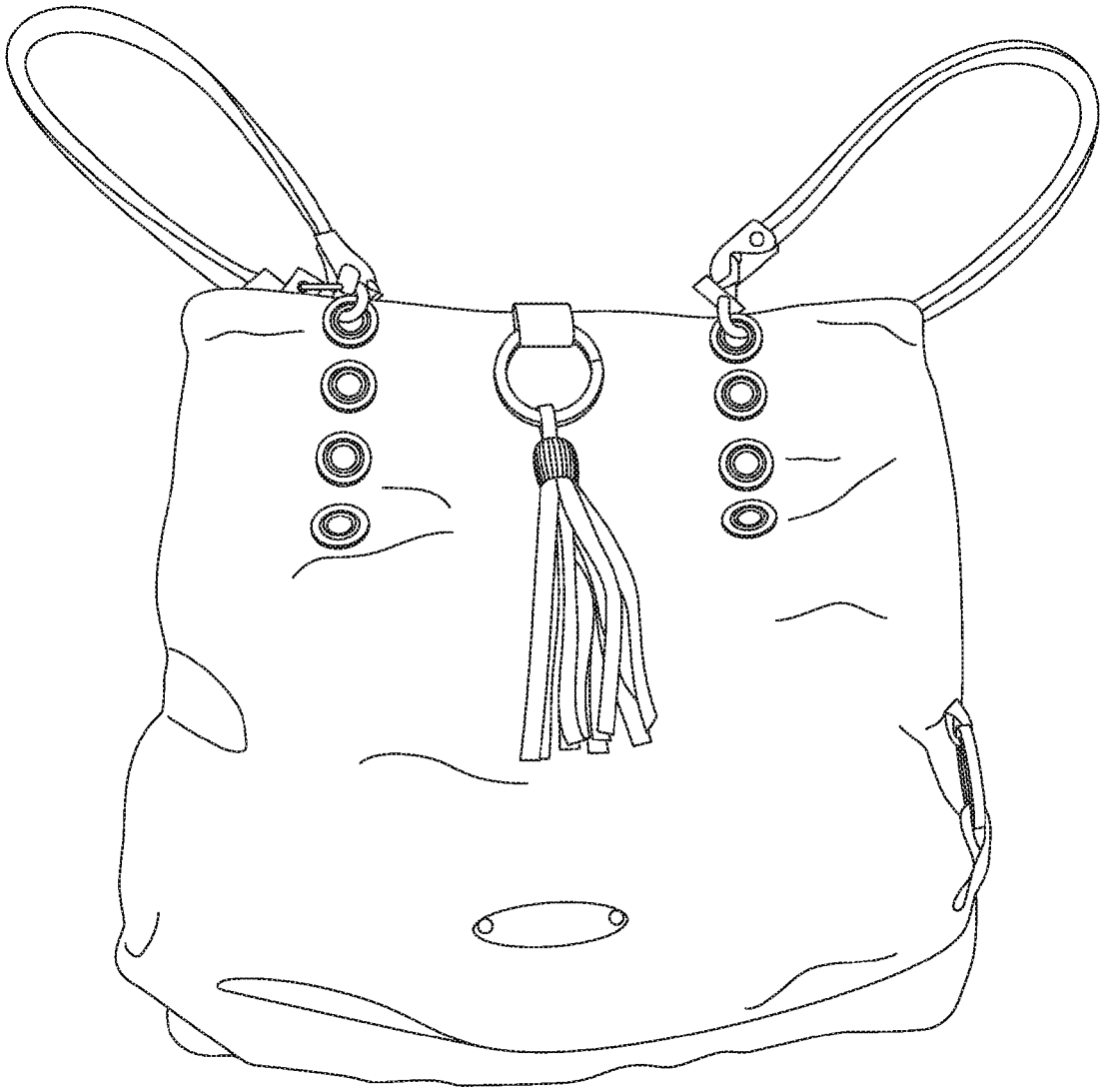
FIG. 23 is a front view of a "back pack" configuration of the bag in FIG. 1, showing the fabric side.
Figure 24:
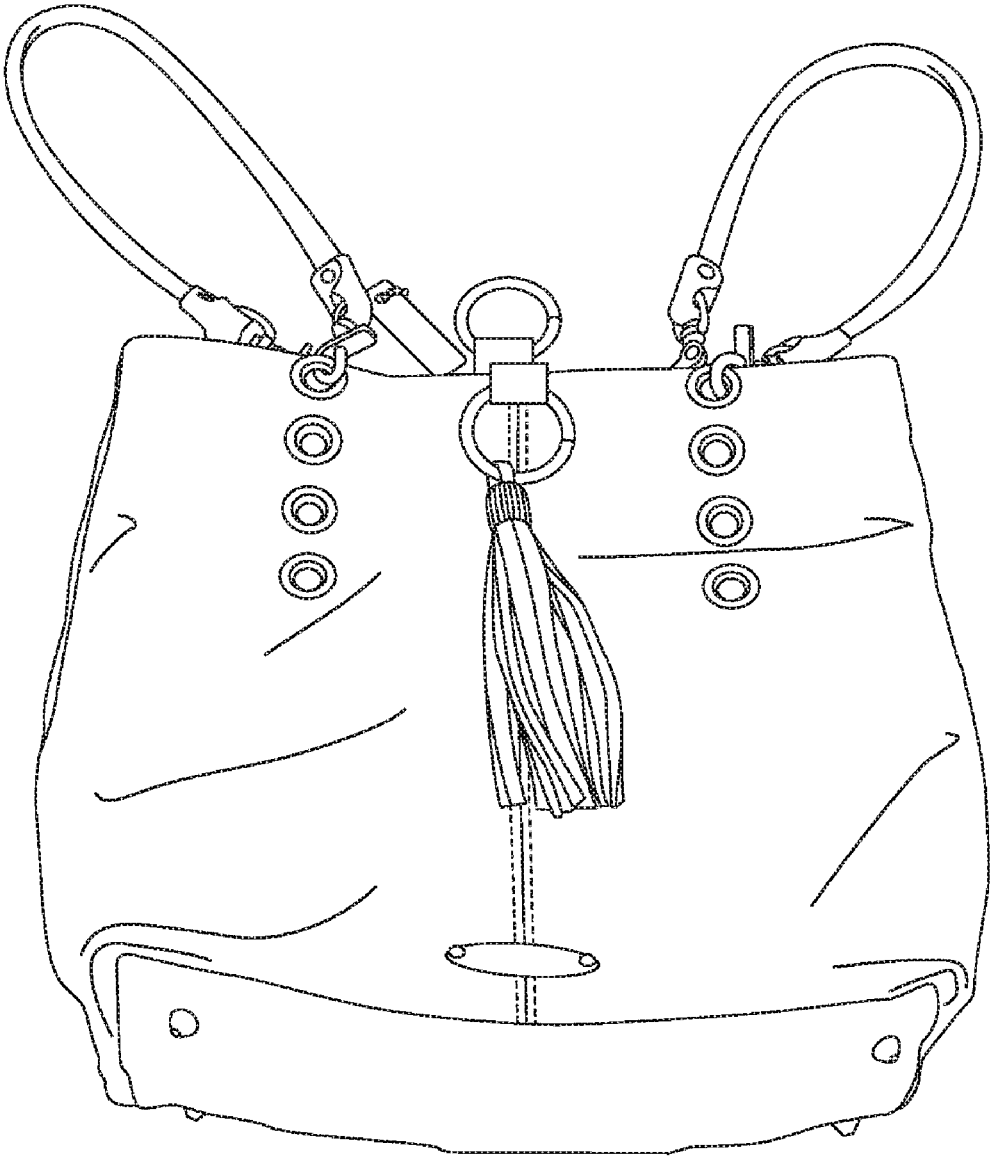
FIG. 24 is a front view of a "back pack" configuration of the bag in FIG. 1, showing the leather side.
Figure 25:
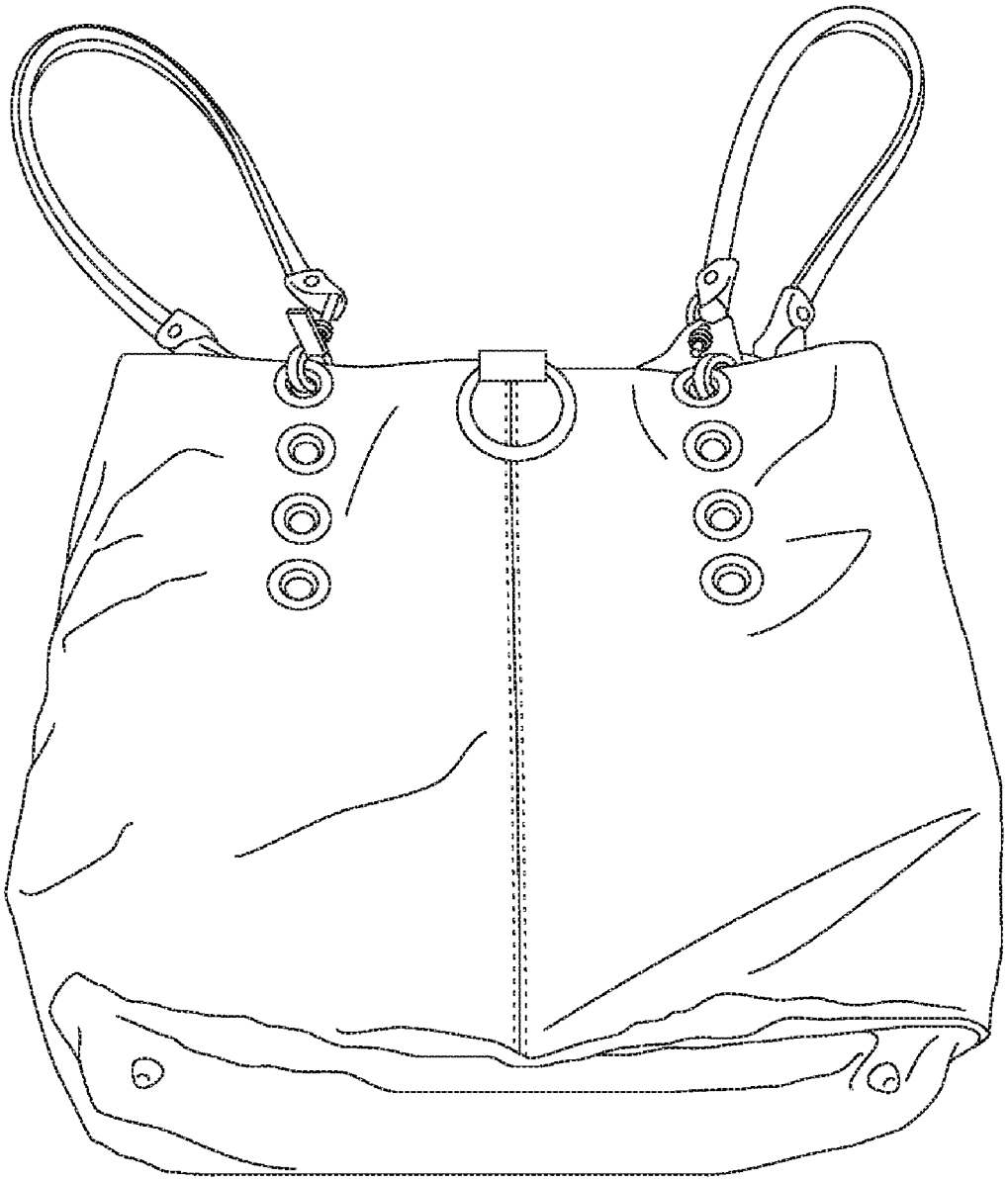
FIG. 25 is a rear view of a "back pack" configuration of the bag in FIG. 1, showing the leather side.
Figure 26:
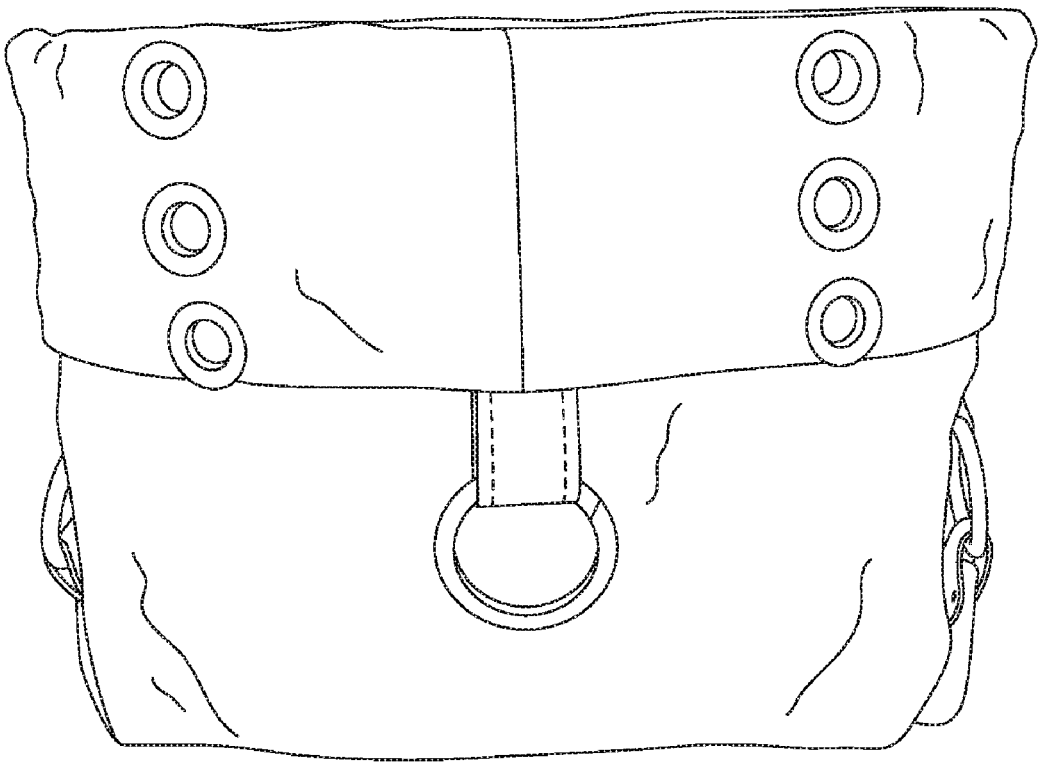
FIG. 26 is a front view of one configuration of the bag in FIG. 1, showing the leather side folded over.
Figure 27:
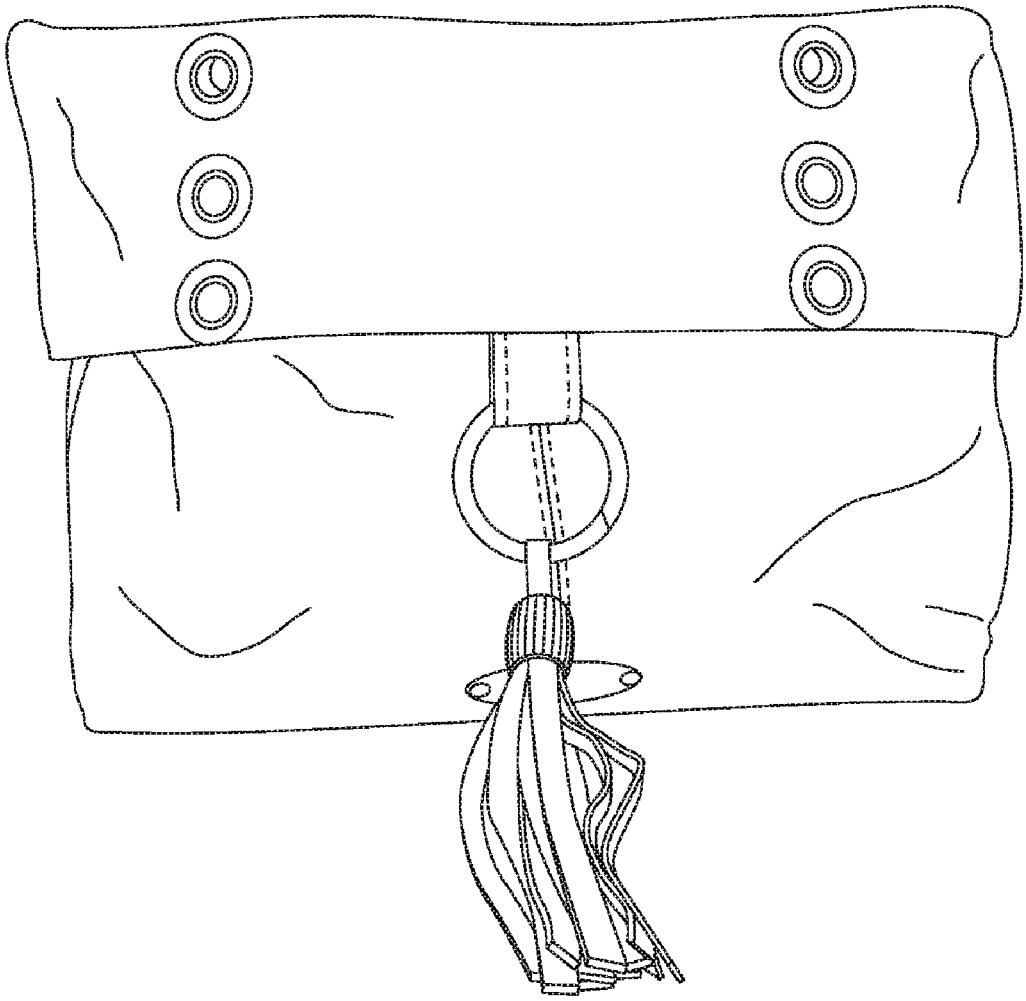
FIG. 27 is a front view of one configuration of the bag in FIG. 1, showing the fabric side folded over.
Figure 28:
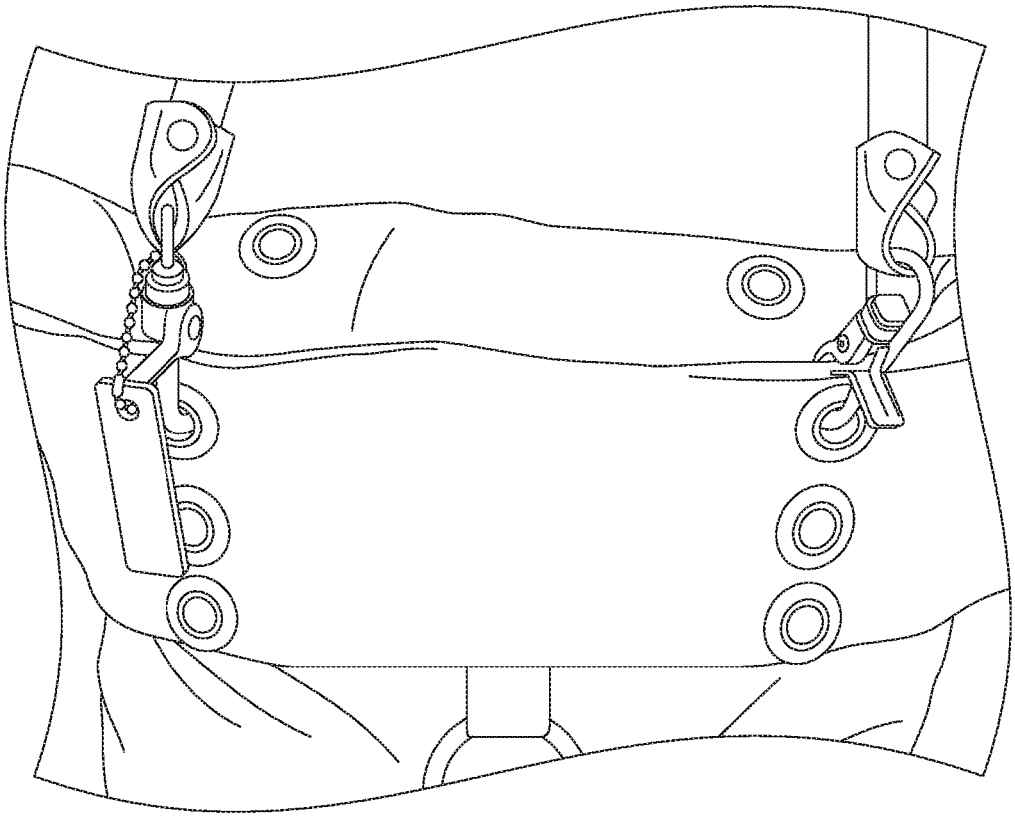
FIG. 28 is a top aspect view of one configuration of the bag in FIG. 1, showing the fabric side folded over.
Figure 29:
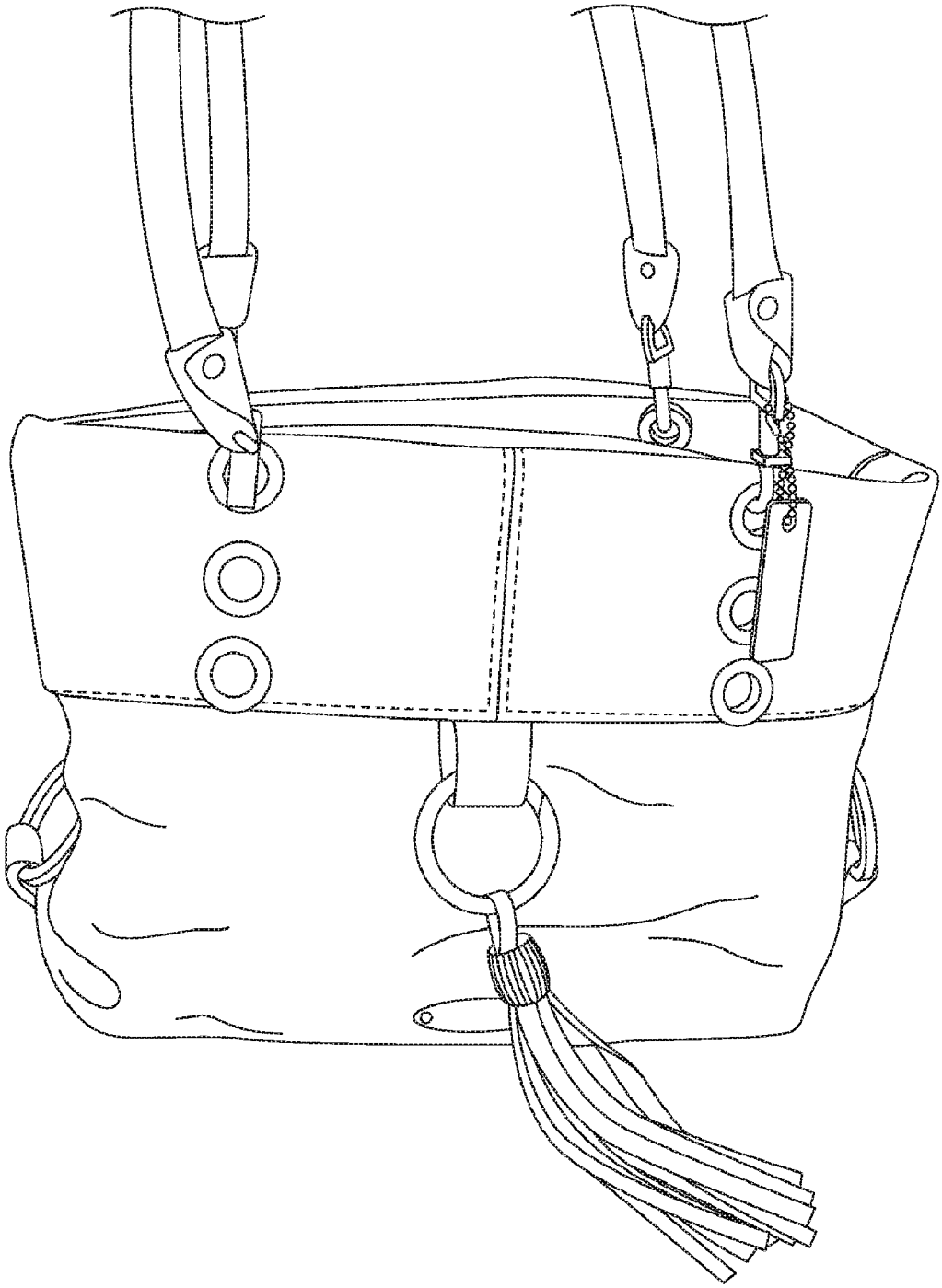
FIG. 29 is a front view of one configuration of the bag in FIG. 1, showing the leather side folded over.
Figure 30:
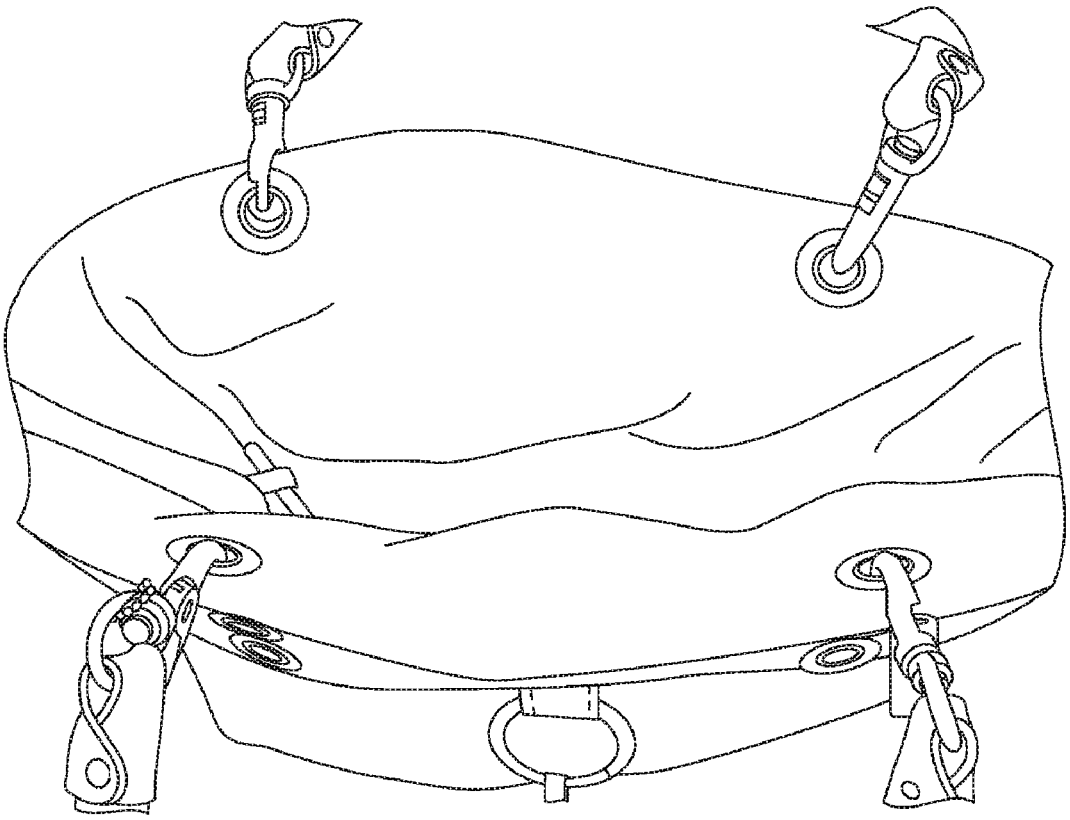
FIG. 30 is a top view of one configuration of the bag in FIG. 1, showing the fabric side folded over.
Figure 31:
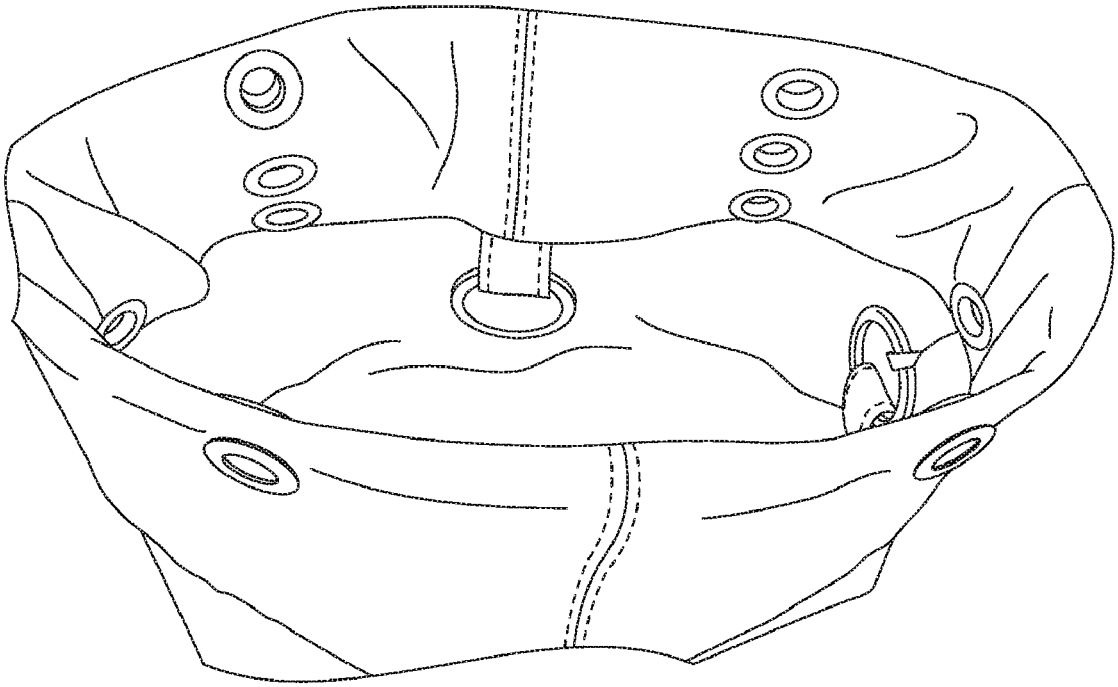
FIG. 31 is a top view of one configuration of the bag in FIG. 1, showing the leather side folded over.
Figure 32:
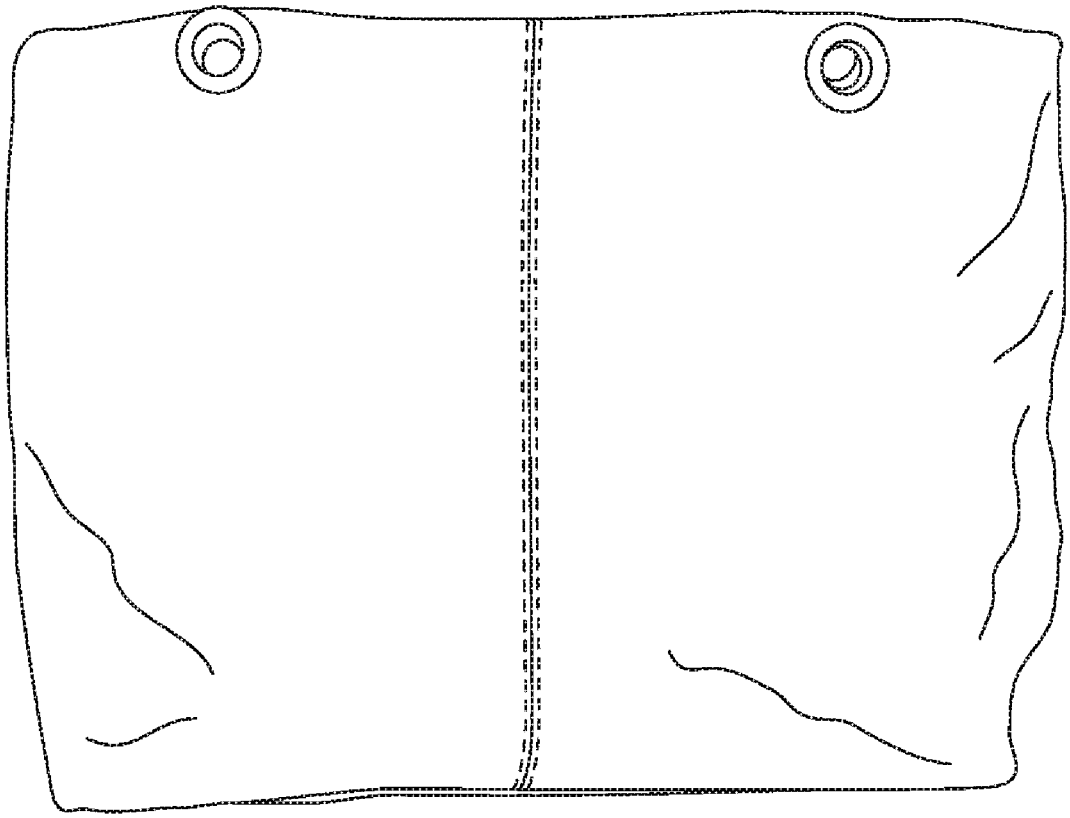
FIG. 32. is a front view of an "evening bag" configuration of the bag in FIG. 1, showing the leather side.
Figure 33:
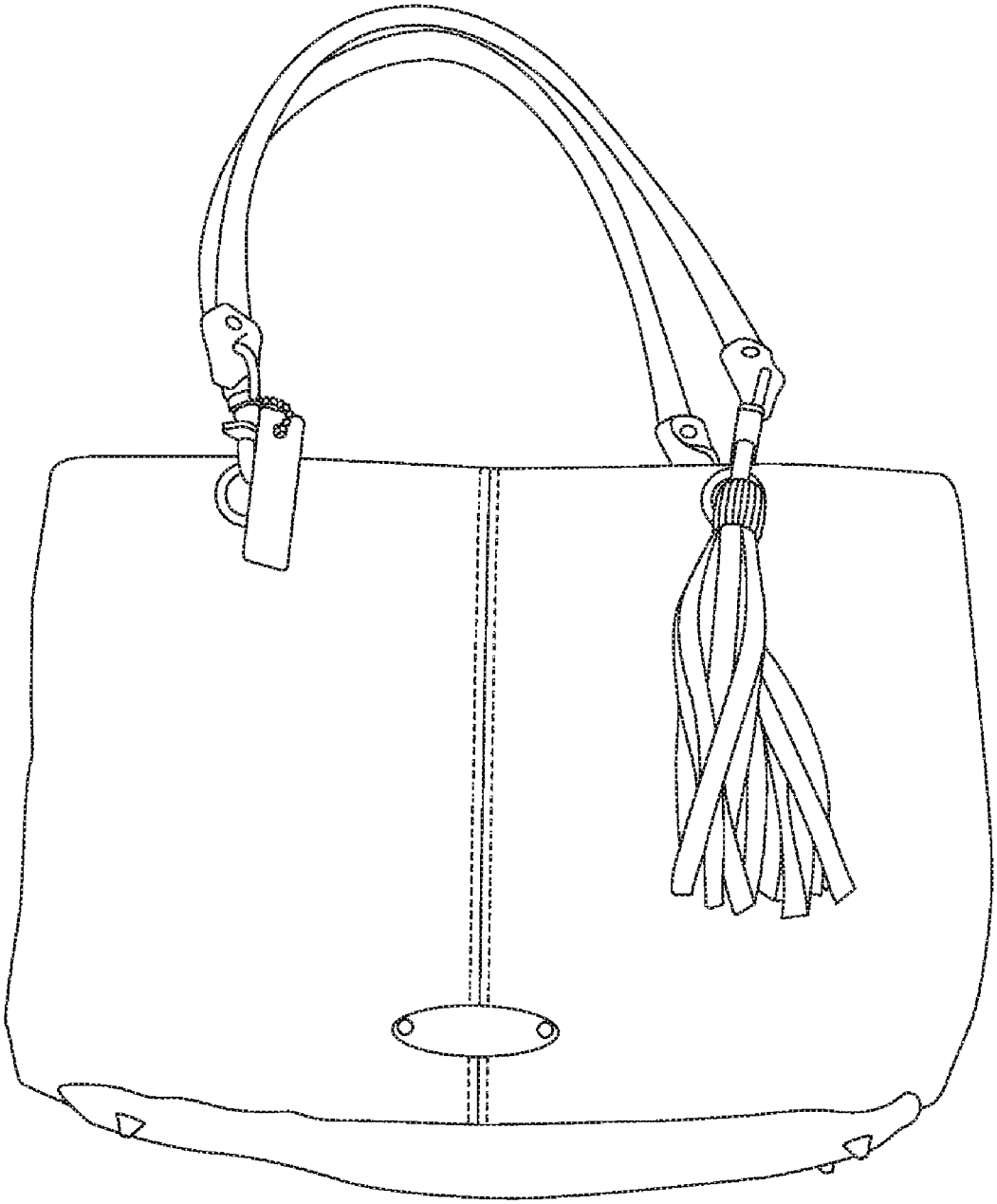
FIG. 33 is a front view of one configuration of the bag in FIG. 1, showing the leather side and attached handles.
Figure 34:
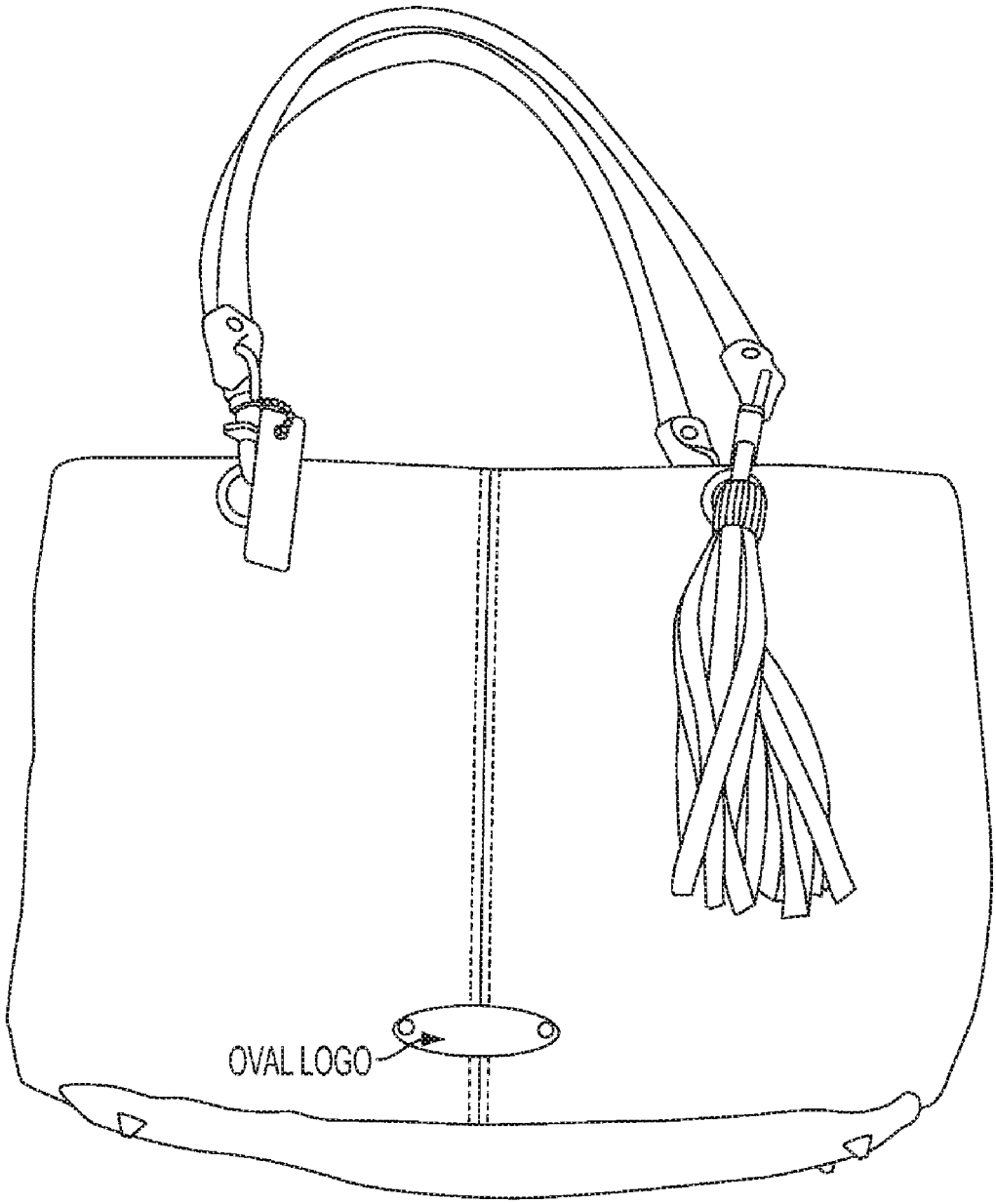
FIG. 34 is a front view of one configuration of the bag in FIG. 1, showing the leather side, attached handles, and logo plate.
Figure 35:
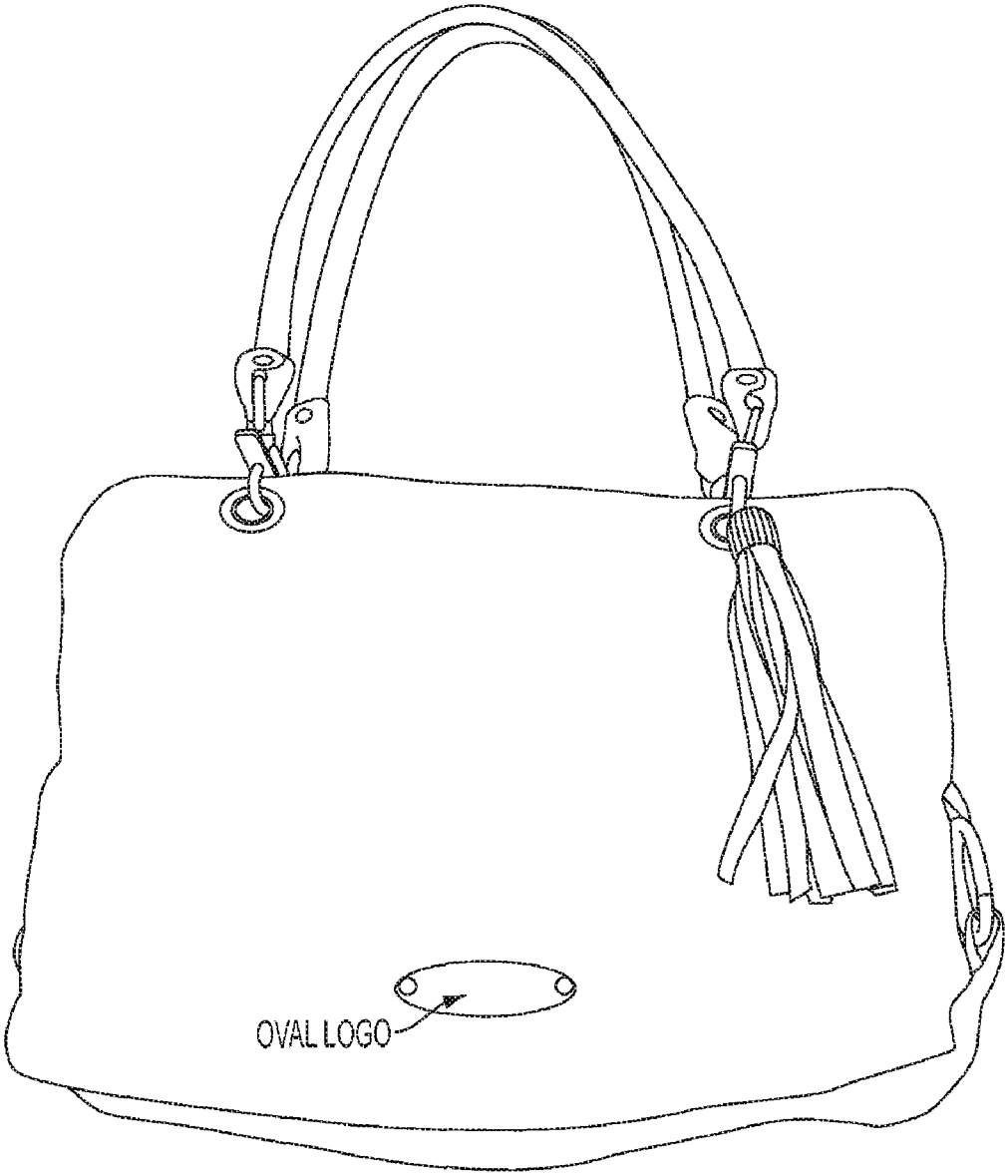
FIG. 35 is a front view of one of the bag in FIG. 1, showing the fabric side, attached handles, and logo plate.
Figure 36:
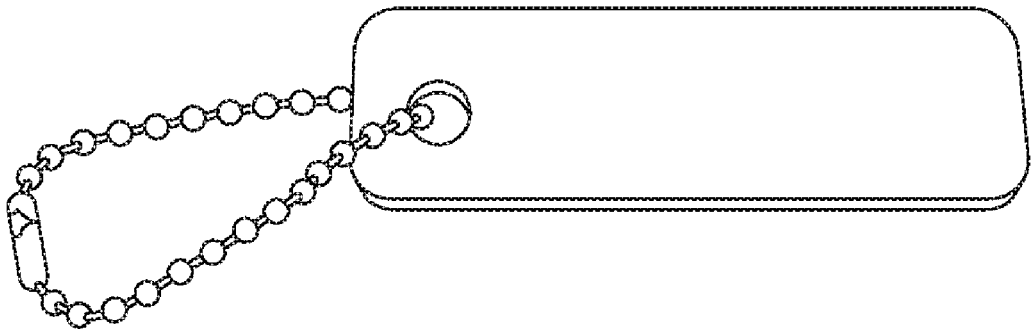
FIG. 36 is a front view of a rectangular hang tag.

By clipping the two long leather handles together at one end to create a long handle (FIG. 21), the user can transform the bag to a cross-the-body "messenger bag" (FIG. 22).

In another embodiment, a "back pack" can be achieved by clipping the handles to the opposite four provided top grommets (FIG. 23) fabric view and (FIG. 24) front leather view, (FIG. 25) rear leather view. As the bag is folded down (cuffed) (FIG. 26) leather over fabric or (FIG. 27), the grommet, eyelet (or similar device) placement is designed so that the holes "line up" so as to provide a means to clip the ends of the handles through two grommets, eyelets (or similar device) (FIG. 28) fabric over leather view, and (FIG. 29) leather over fabric view, thereby providing the ability to have full use of handles at each fold height. This holds true for both sides of the bag, and whether the top is cuffed to the outside (FIG. 30) or folded to the inside (FIG. 31); as the grommets, eyelets (or similar device) are installed to be useful on either reversed side. Therefore all the same transformations that are designed for one side of the bag can be duplicated on the opposite side of the bag, providing a stunningly dramatic change in look and style depending on which side (or sides) the user exposes.

Figure 37:
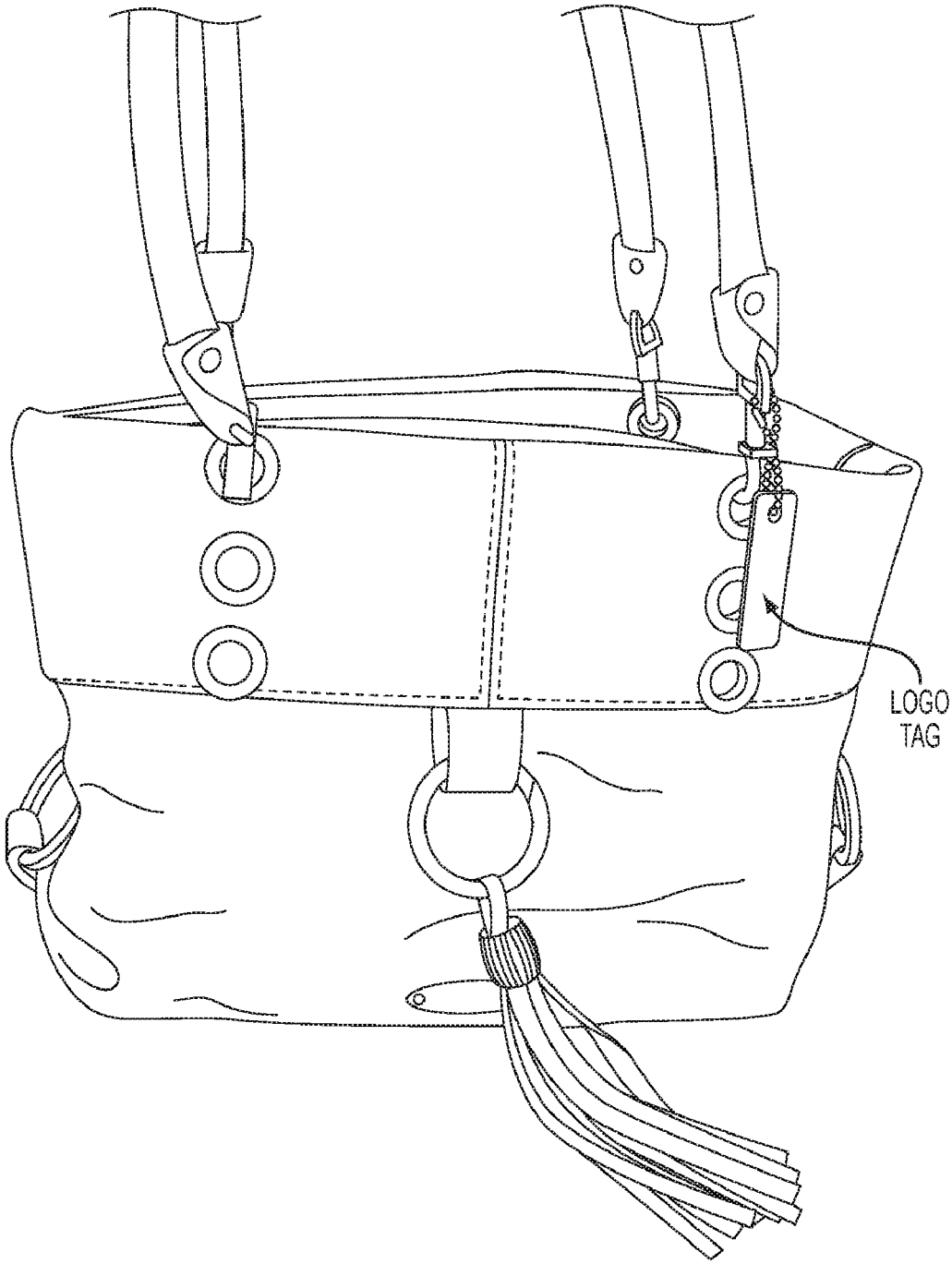
FIG. 37 is a front view of one of the bag in FIG. 1, showing the leather side folded over and a hang tag attached.
Figure 38:
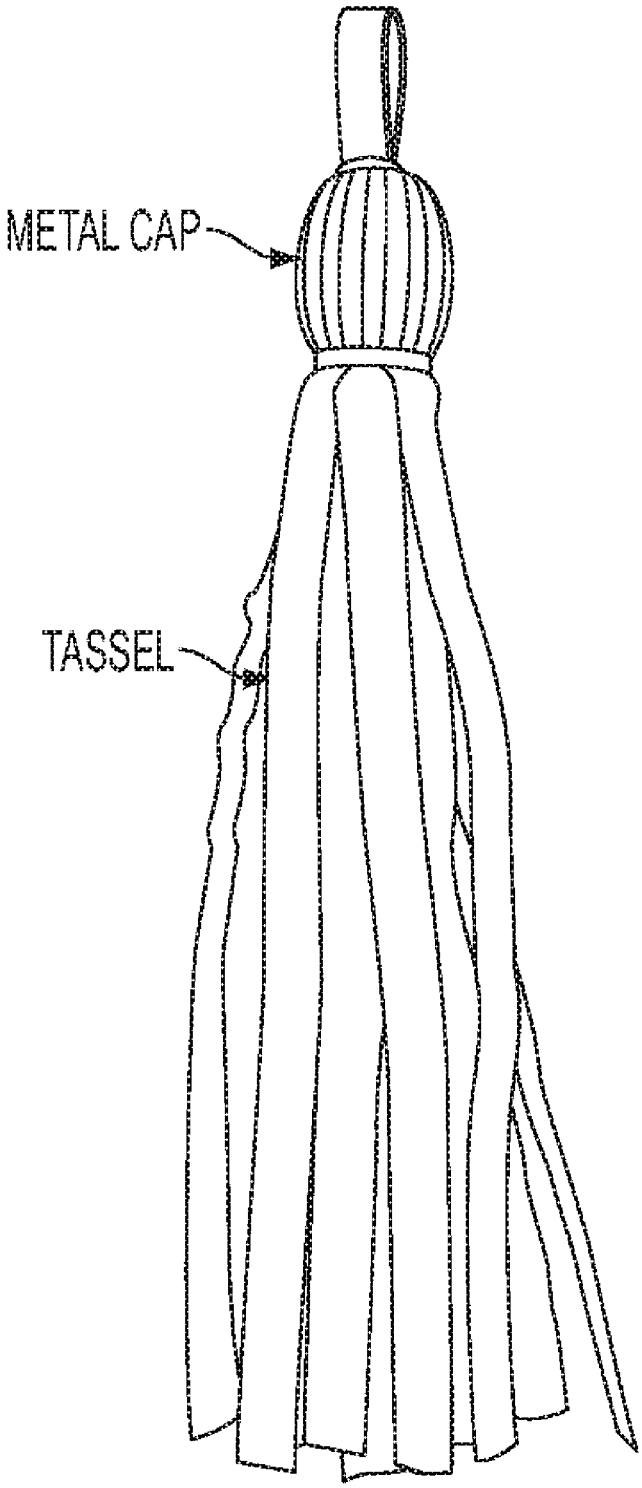
FIG. 38 is a front view of a tassel.
Figure 39:
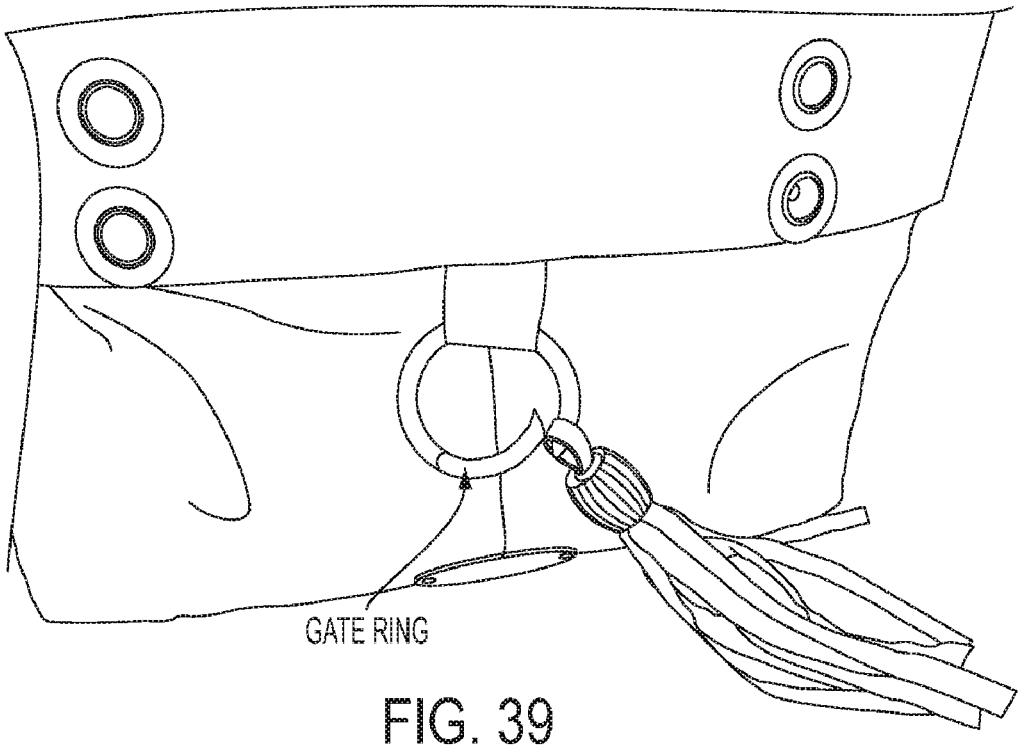
FIG. 39 is a front view of one embodiment of the bag in FIG. 1, with a tassel attached.
Figure 40:
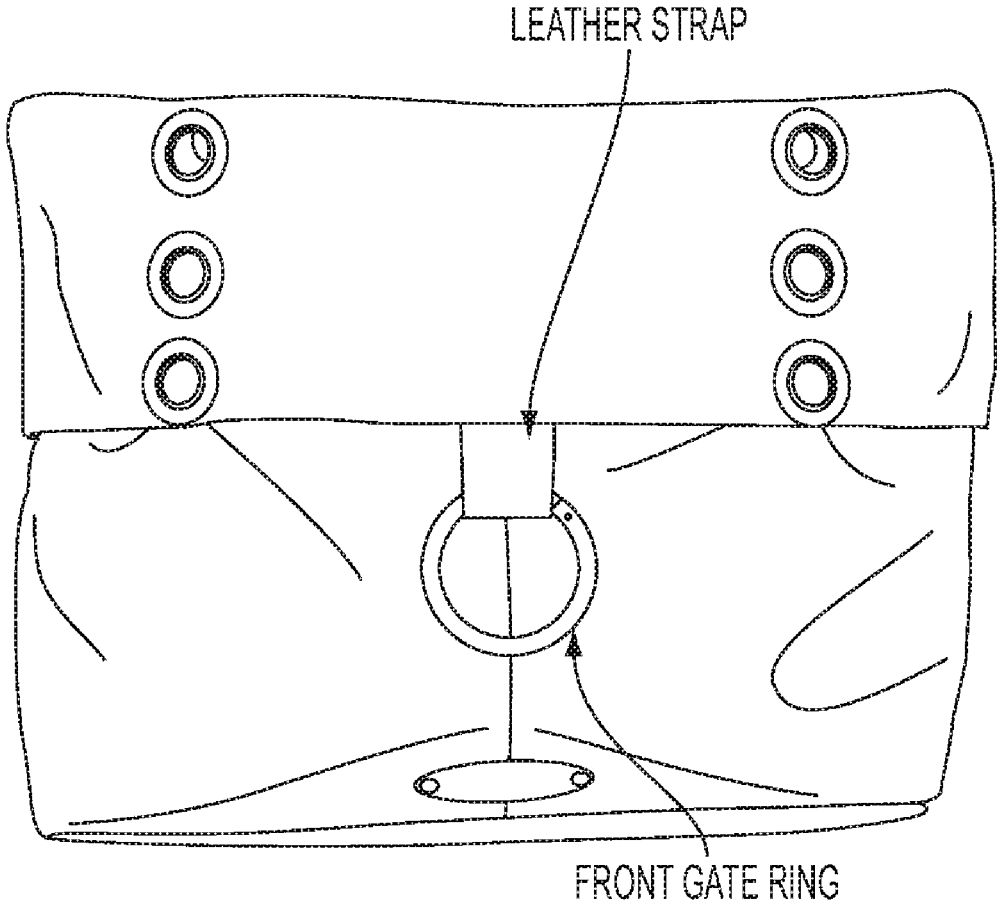
FIG. 40 is a front view of one embodiment of the bag in FIG. 1, showing the fabric side folded over and a gate ring attached.
Figure 41:
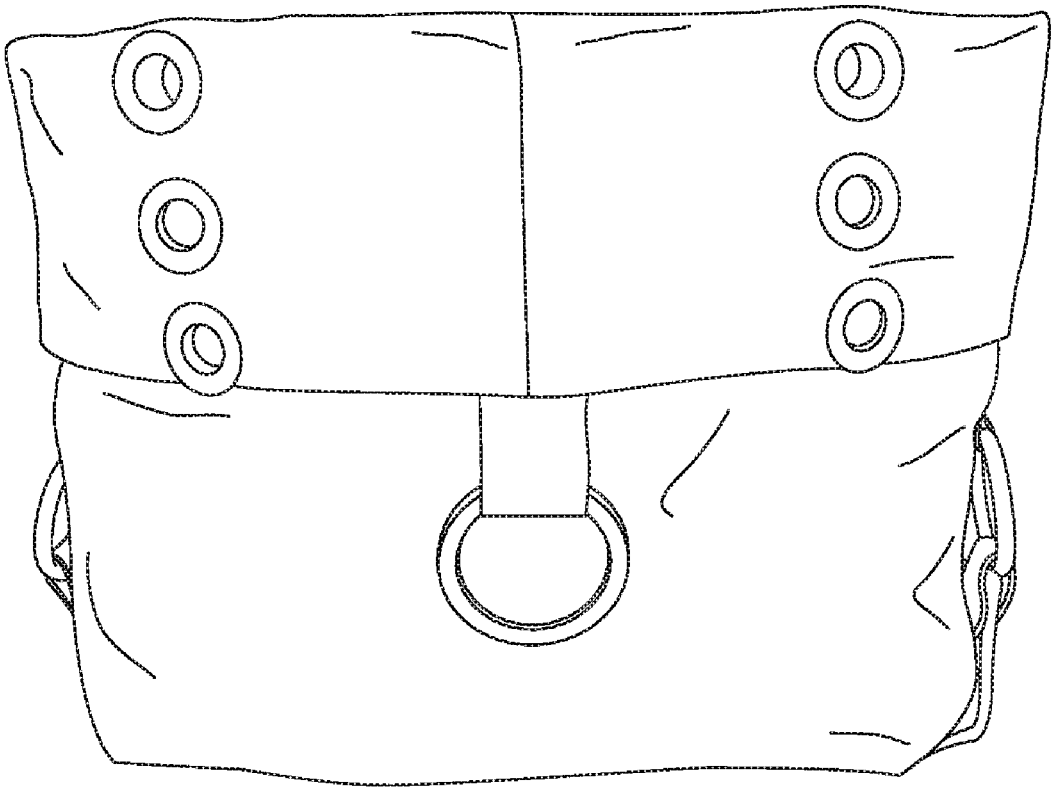
FIG. 41 is a front view of one embodiment of the bag in FIG. 1, showing the leather side folded over.
Figure 42:
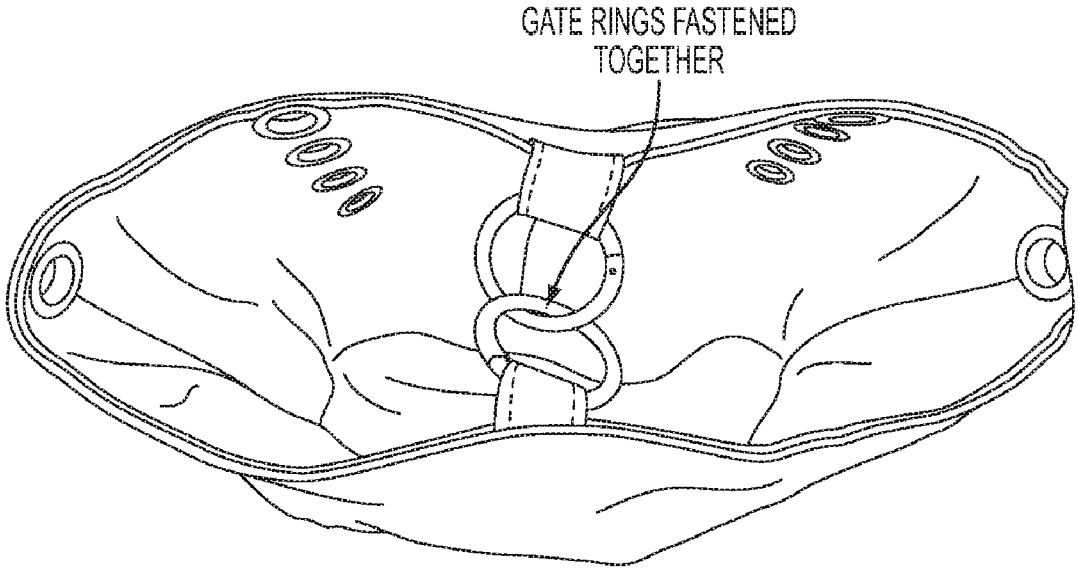
FIG. 42 is a top view of one embodiment of the bag in FIG. 1, showing interlocking rings attached.

Embodiments allow the user to fold the bag inwards to its smallest size (to the lowest grommet, eyelet or similar device) (FIG. 32) view without handles, providing an "evening bag" look and style, usually displaying only one side of the bag (FIG. 33) view with handles. The uniqueness and distinctiveness of the handbag design is further enhanced by the placement of an oval colored metal logo plate on the front of each side of the bag (FIG. 34) leather side view and (FIG. 35) fabric side view, clearly identifying it as the "Chouette" brand. In addition to the logo plate, a rectangular leather hang tag (FIG. 36) is attached to the bag by a short ball chain, and imprinted with the "Chouette" logo (FIG. 37).

Figure 43:
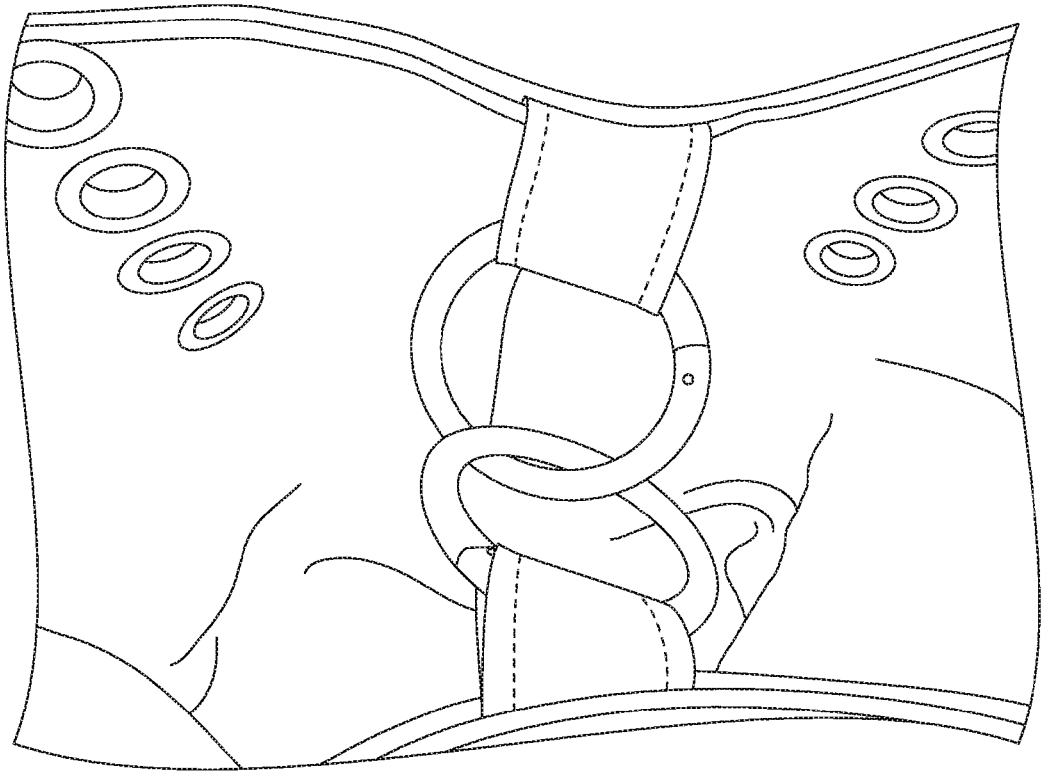
FIG. 43 is a close-up top view of one embodiment of the bag in FIG. 1, showing interlocking rings attached.
Figure 44A:
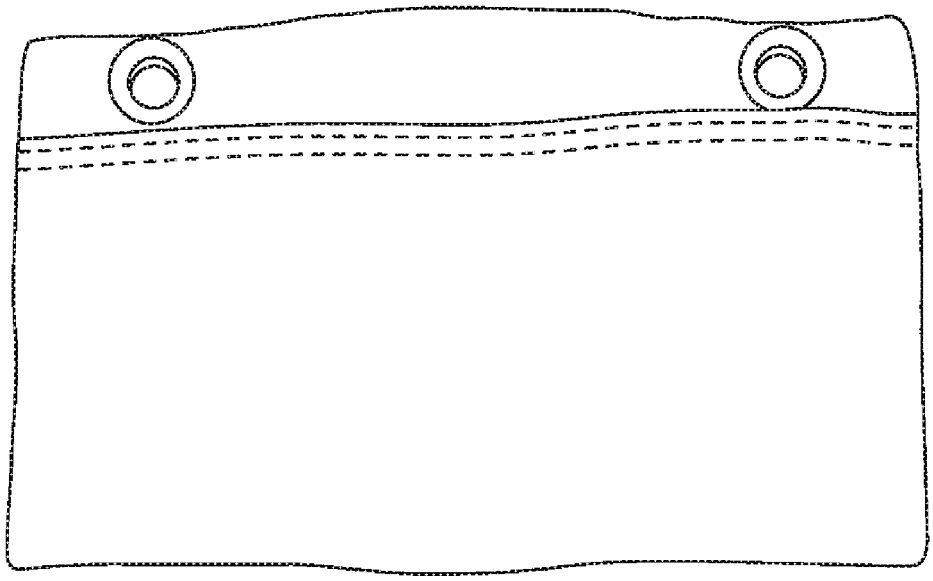
FIG. 44 is a front and rear view of one embodiment of the interior bag of the present invention.
Figure 44B:
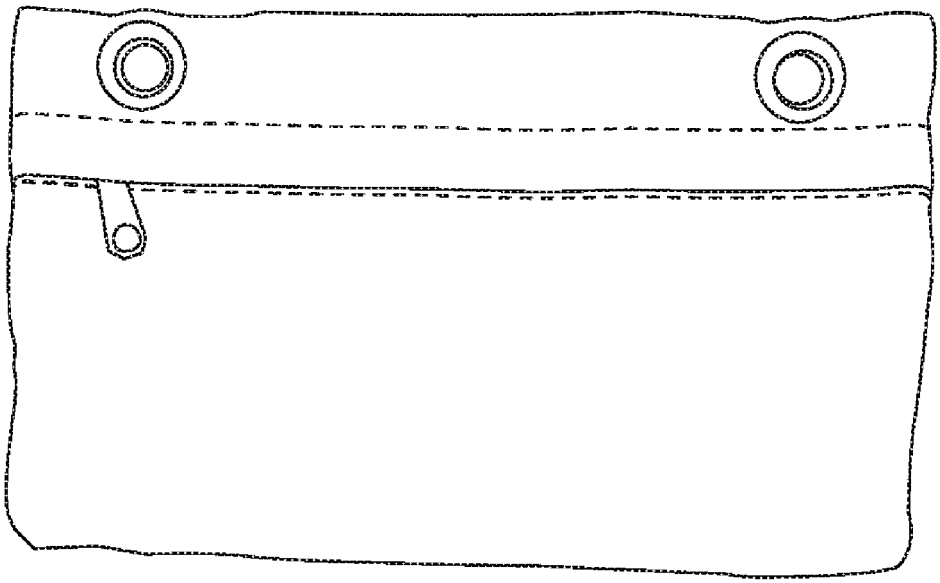
Figure 45:
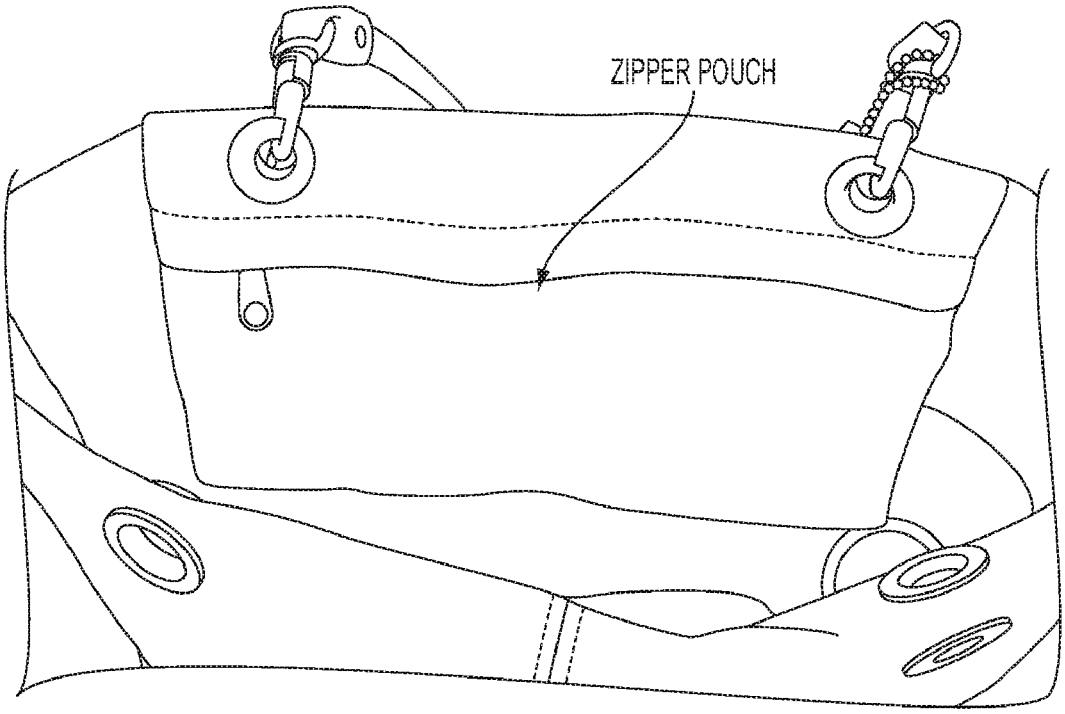
FIG. 45 is a top aspect view of one embodiment of the bag in FIG. 1, shown with the interior bag in FIG. 44 attached.

A distinctive removable leather tassel with a metal cap (FIG. 38) can be moved from one location to another on the bag by unclipping it from one of the distinctive opening "gate rings" (39), clasps or other similar round spring-loaded devices. Also, centered on each side of the top of the bag is a 2" metal gate ring (or similar spring-loaded open/close type ring) that is attached to a short length of leather allowing the ring to hang down on either side of the bag (FIG. 40) fabric side view and (FIG. 41) leather side view. This ring serves to hold, attach, and detach ornamentation items such as tassels, or to fasten together to close the top edge of the bag (FIG. 42) and (FIG. 43).

Figure 46:
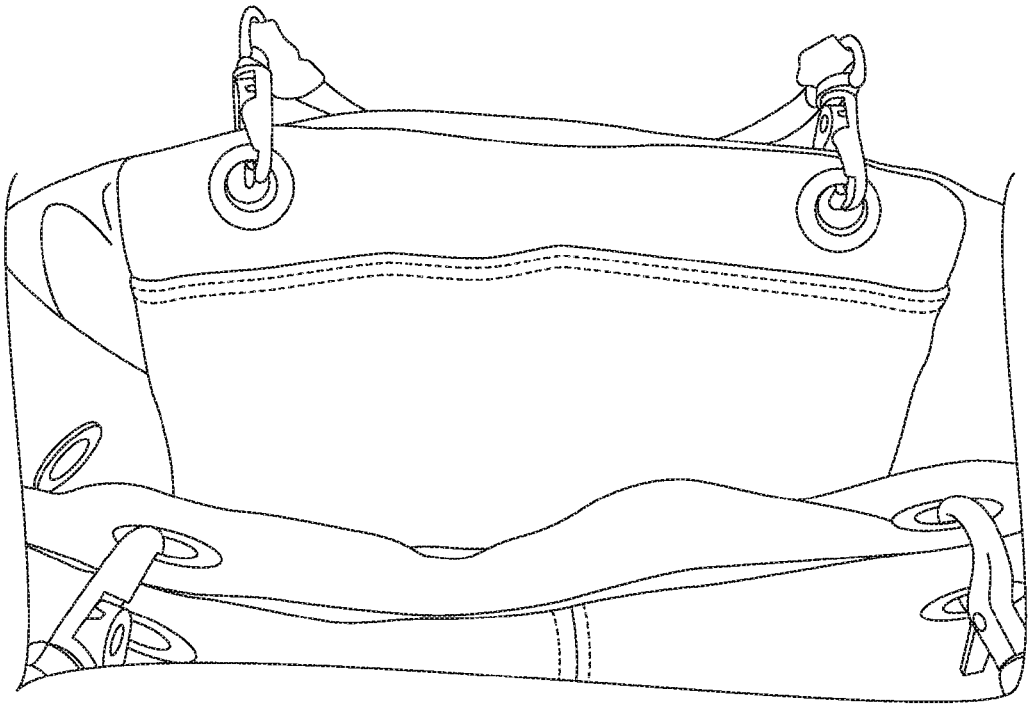
FIG. 46 is a front aspect view of one embodiment, of the bag in FIG. 1, shown with the interior bag in FIG. 44 attached.
Figure 47:
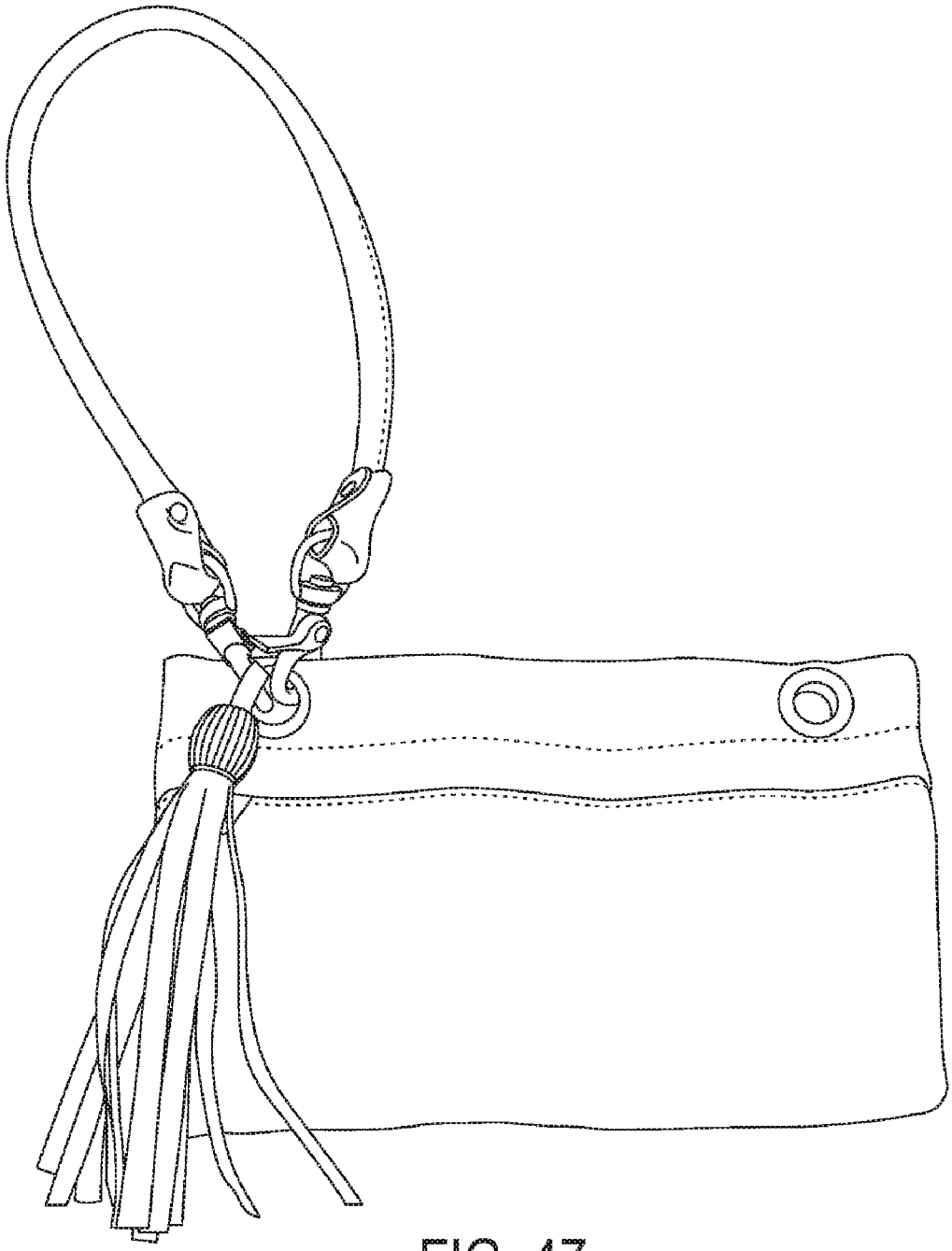
FIG. 47 is a front view of one embodiment of the interior bag in FIG. 44, shown with a handle attached.
Figure 48:
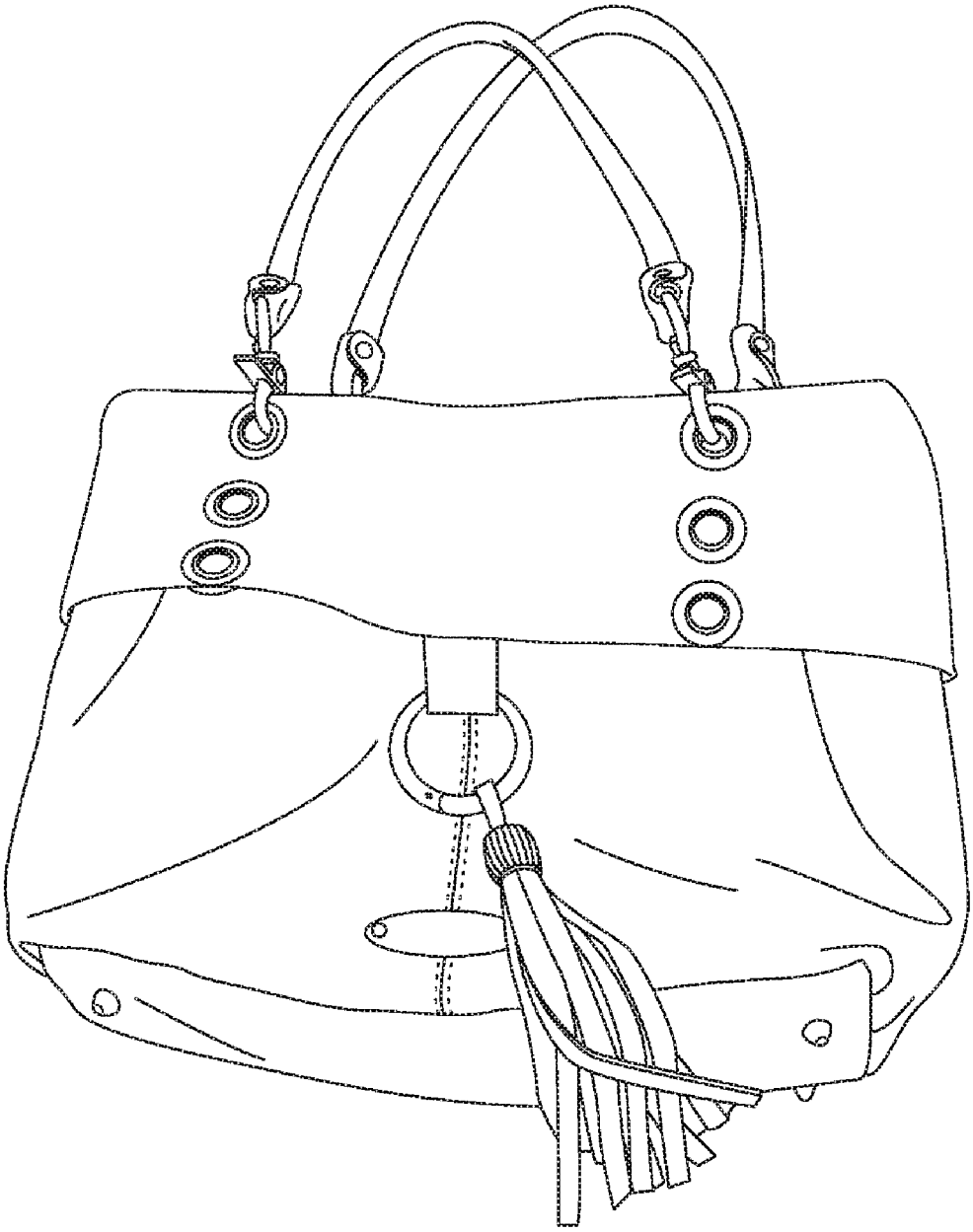
FIG. 48 is a front view of a "dancing bag" configuration of the bag in FIG. 1, showing the fabric side folded over.

Provided with this embodiment of the bag are one or more interior small zippered or pocketed bags, matching the tapestry or fabric of the main bag (FIG. 44), that can be attached to a grommet, eyelet (or similar device), handle clip, or elsewhere in the bag (FIG. 45) zippered pouch attached and pocket bag attached (FIG. 46). This small bag is designed for carrying small items and valuables, and also to be used as a small handbag on its own, separate from the main bag, when one of the provided handles is attached (FIG. 47) shown both handle ends clipped to same hole or (FIG. 48) each end of handle clipped to end holes. It is designed to be used as a "cocktail" or "dancing" bag.

Figure 3:
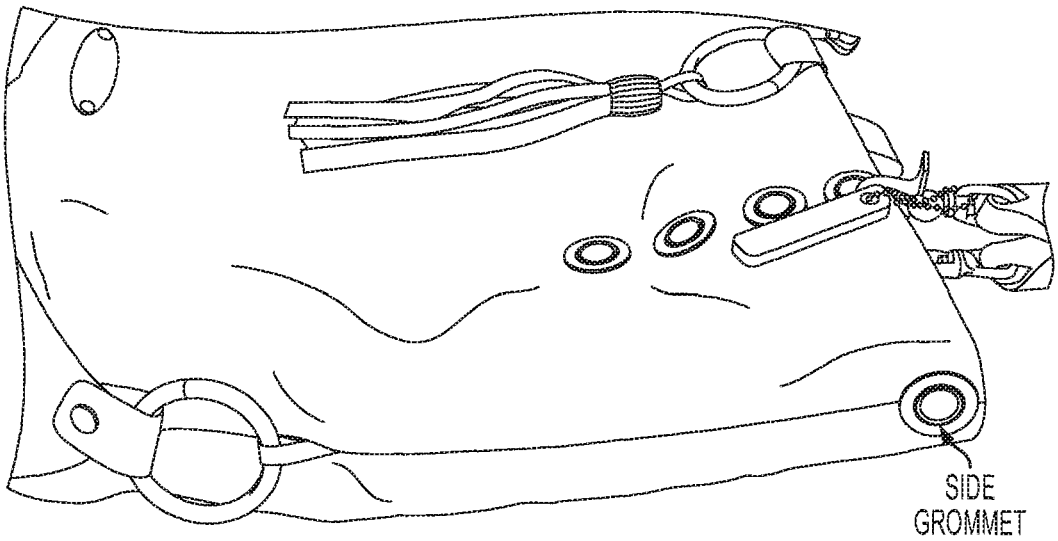
FIG. 3 is a side view of the bag in FIG. 1.
Figure 4:
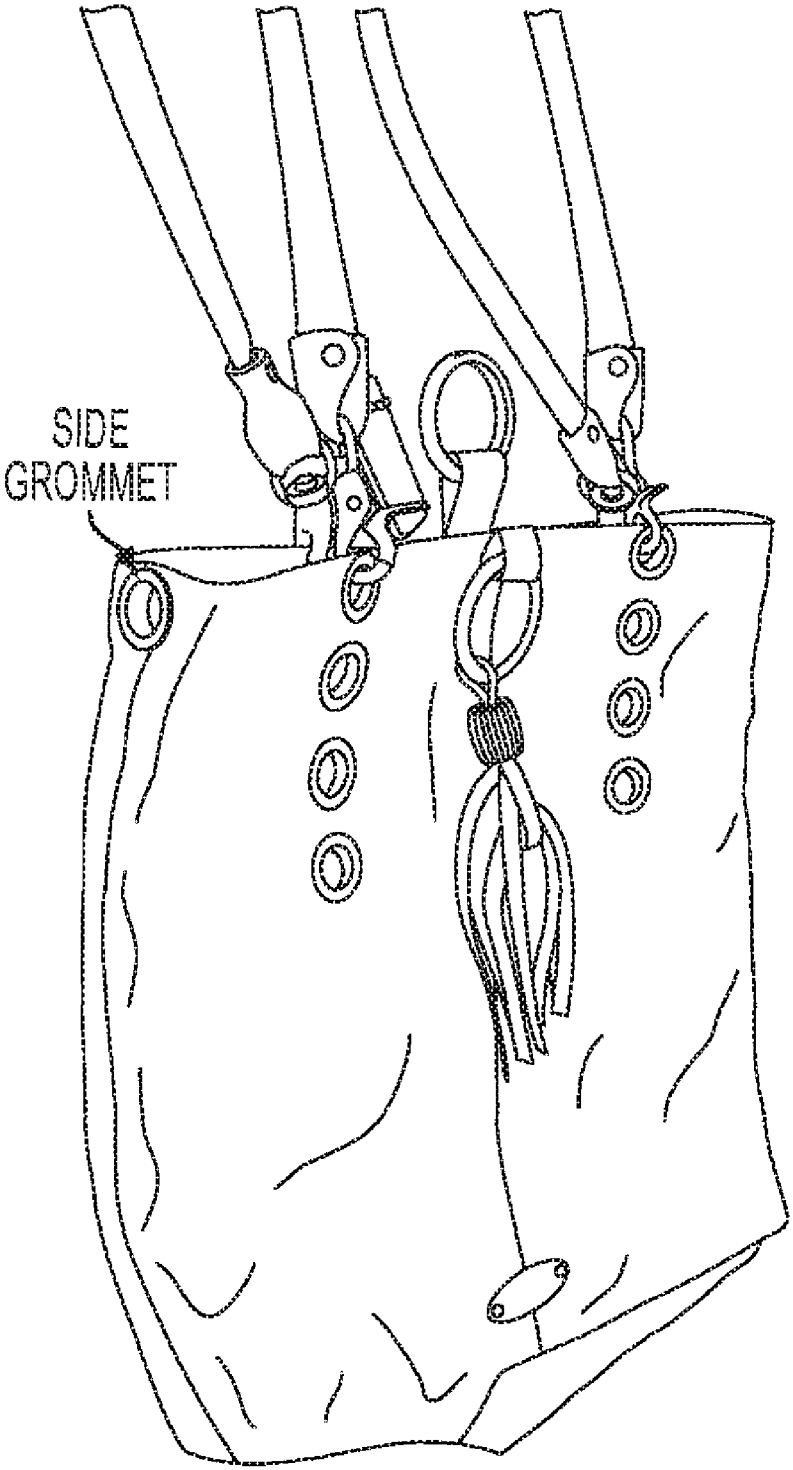
FIG. 4 is a side aspect of view of the bag in FIG. 1.
Figure 5:
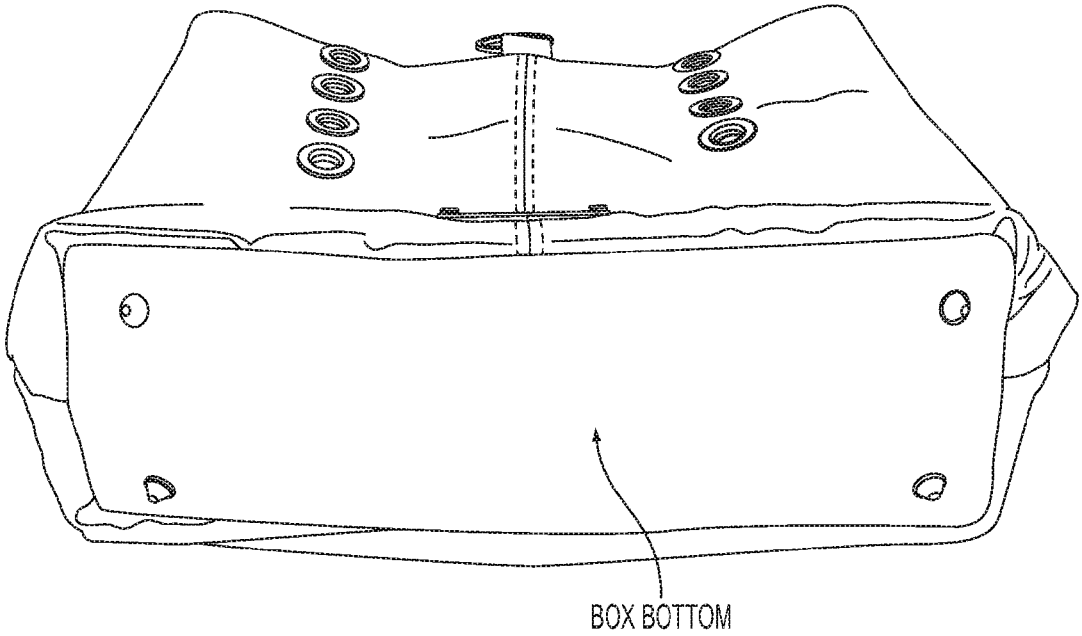
FIG. 5 is a bottom view of the bag in FIG. 1, showing the leather side.

The described embodiments provide a single reversible and transformable handbag that can provide 17 or more styles and looks without carrying extra parts allowing full reversibility with two distinctly different and useful sides, coupled with the added ability to transform the look of the bag further by folding and exposing the interior and exterior finished fabric or leather in varying degrees of fashion style, showing two different handbag bottoms (FIG. 5) and (FIG. 6), and using strategically placed grommets, eyelets (or similar devices) to attach and detach the provided handles to convert the bag to many different looks (FIG. 1) and (FIG. 3).

Figure 7:
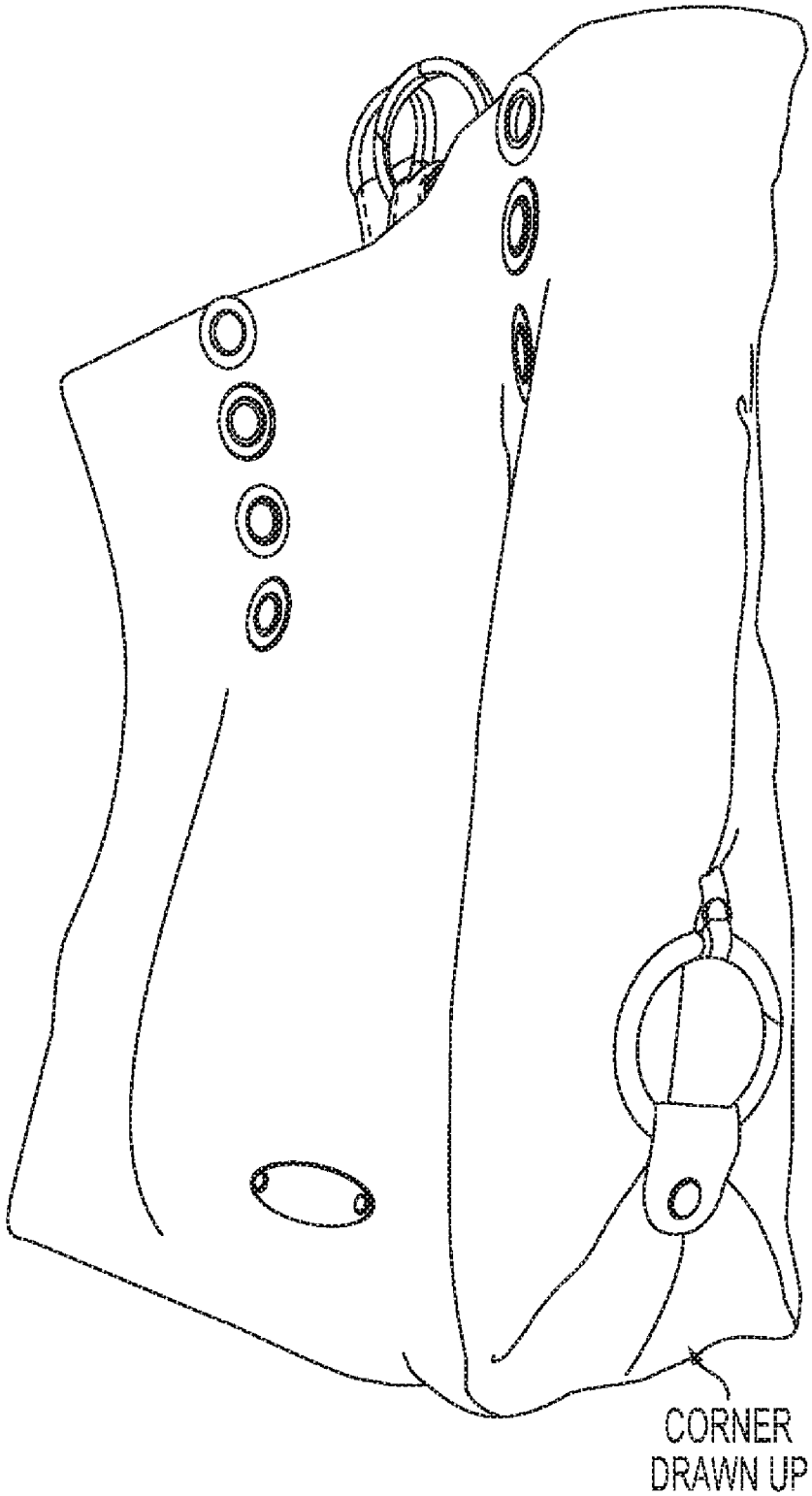
FIG. 7 is a side aspect view of the bag in FIG. 1.
Figure 8:
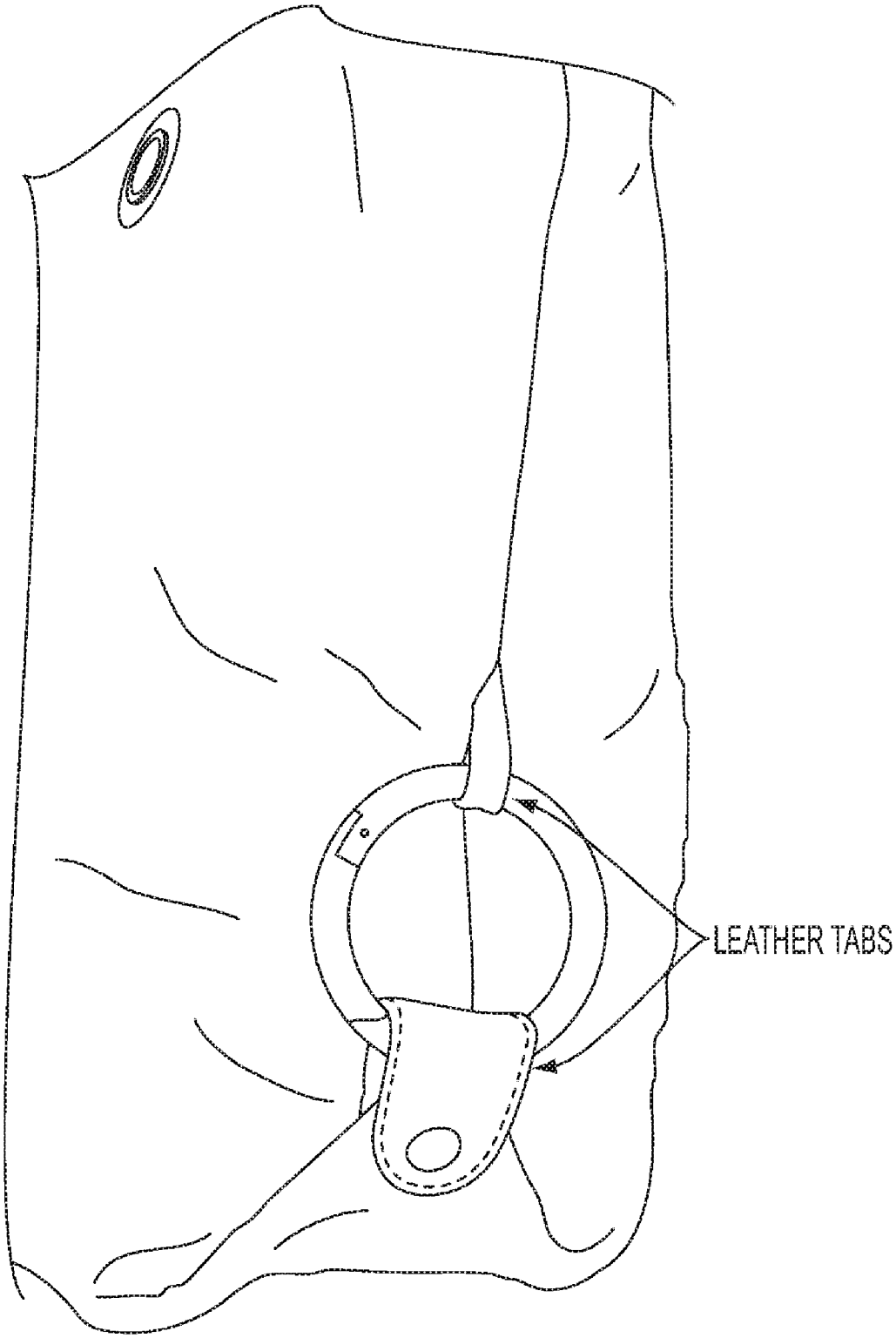
FIG. 8 is a close-up side view of the bag in FIG. 1
Figure 9:
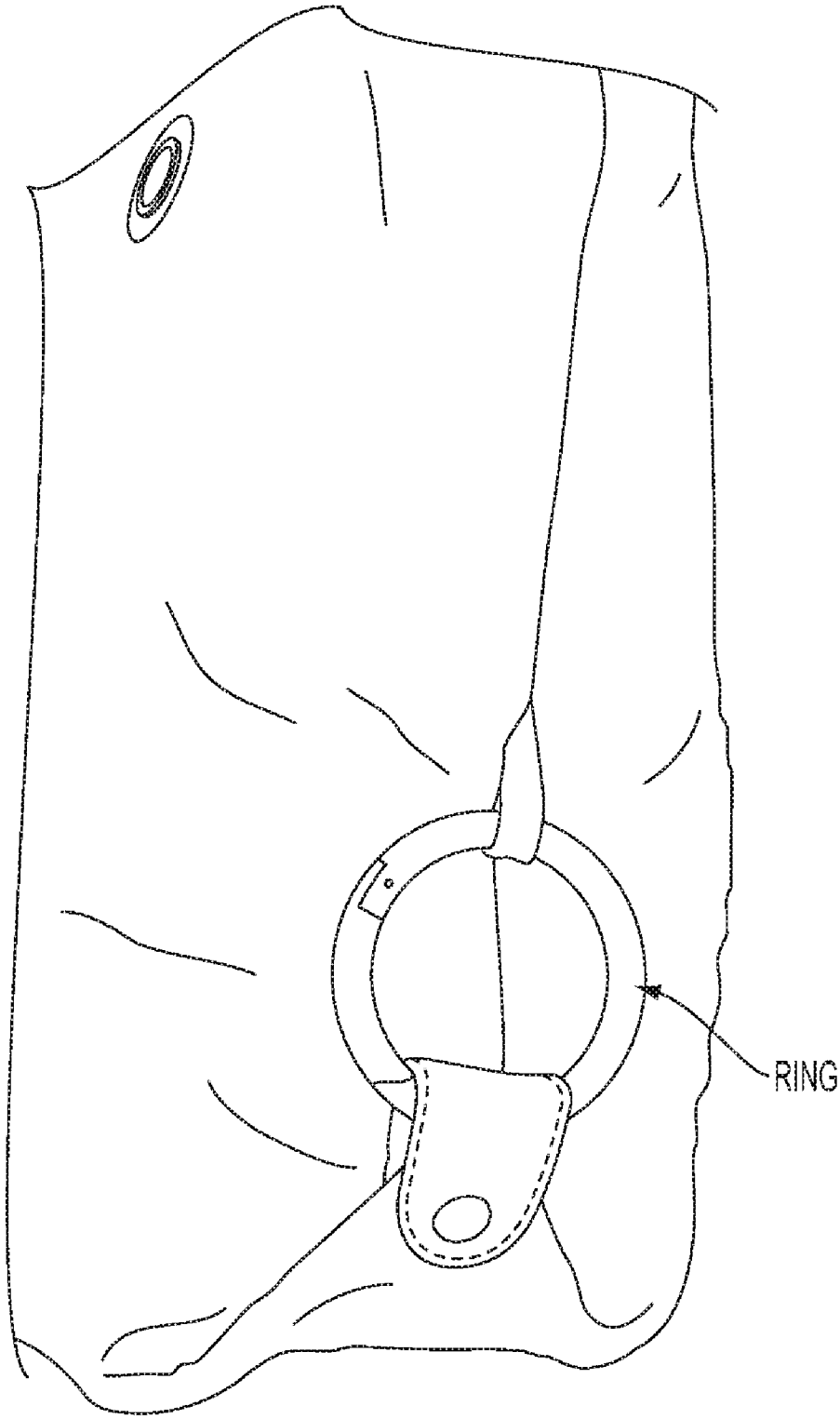
FIG. 9 is another close-up side view of the bag in FIG. 1
Figure 49:
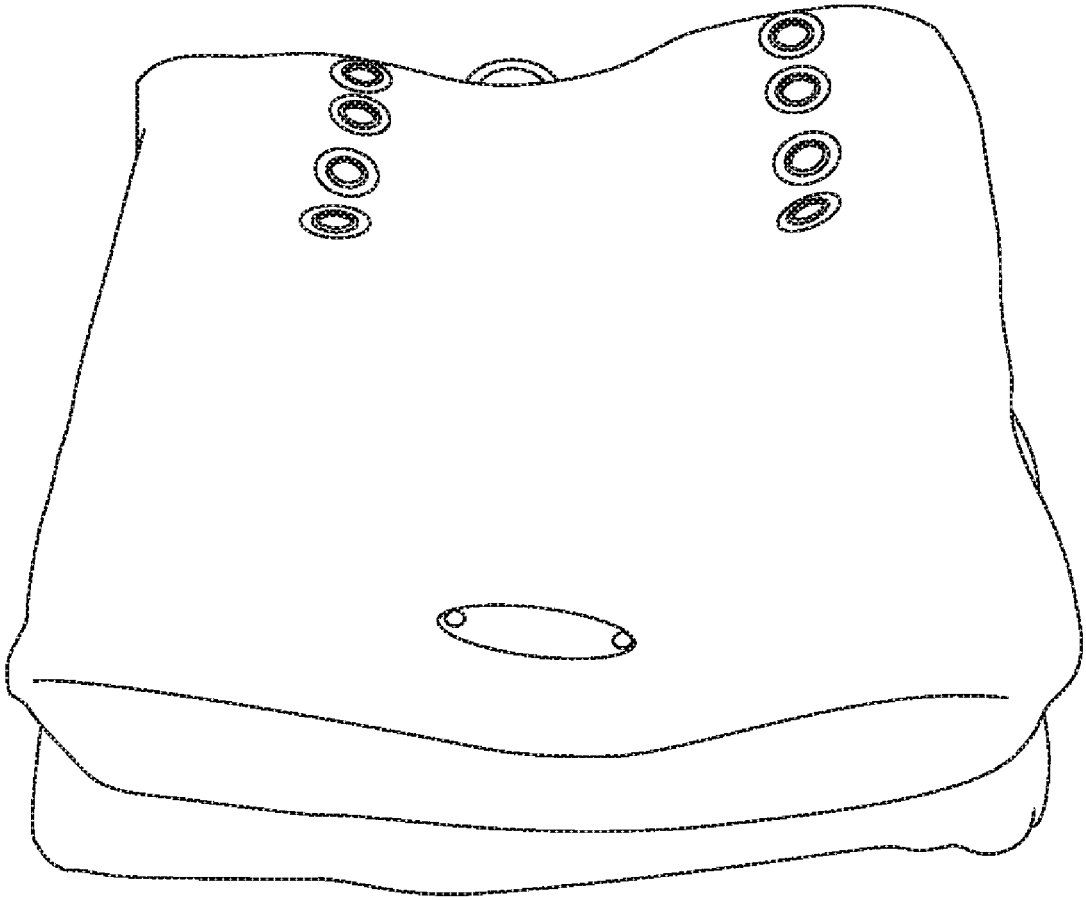
FIG. 49 is a front aspect view of the bag in FIG. 1, showing the fabric side.

In one embodiment, the provided matching padded leather handles measure 26" from the end of one snap hook to the other each (FIG. 49). Other embodiments include several different physical measurements because the bag transforms into several sizes, from the fully extended "tote" size (FIG. 15) to a much smaller "evening bag size" (FIG. 33), and in addition, some of the embodiments of the bag have two different types of bottoms, a flat box type bottom on one side (FIG. 5), and a rounded with drawn up corners type bottom on the opposite side (FIG. 7).

Figure 50:
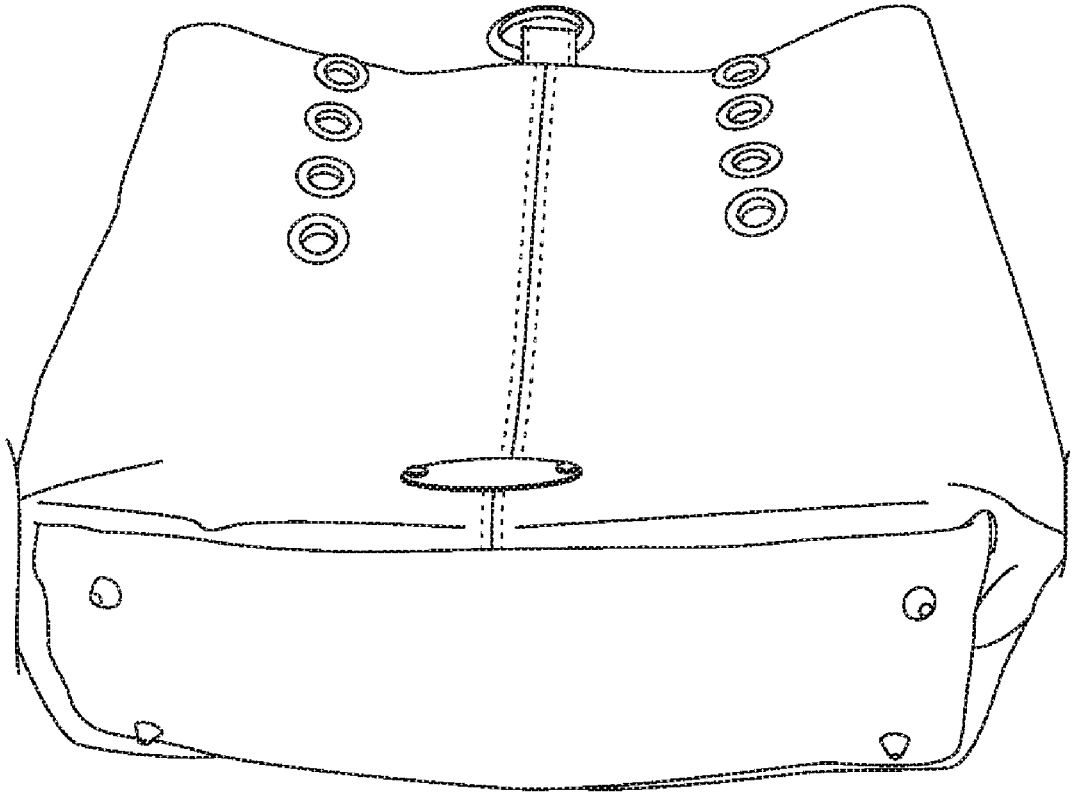
FIG. 50 is a front aspect view of the bag in FIG. 1, showing the leather side.
Figure 51:
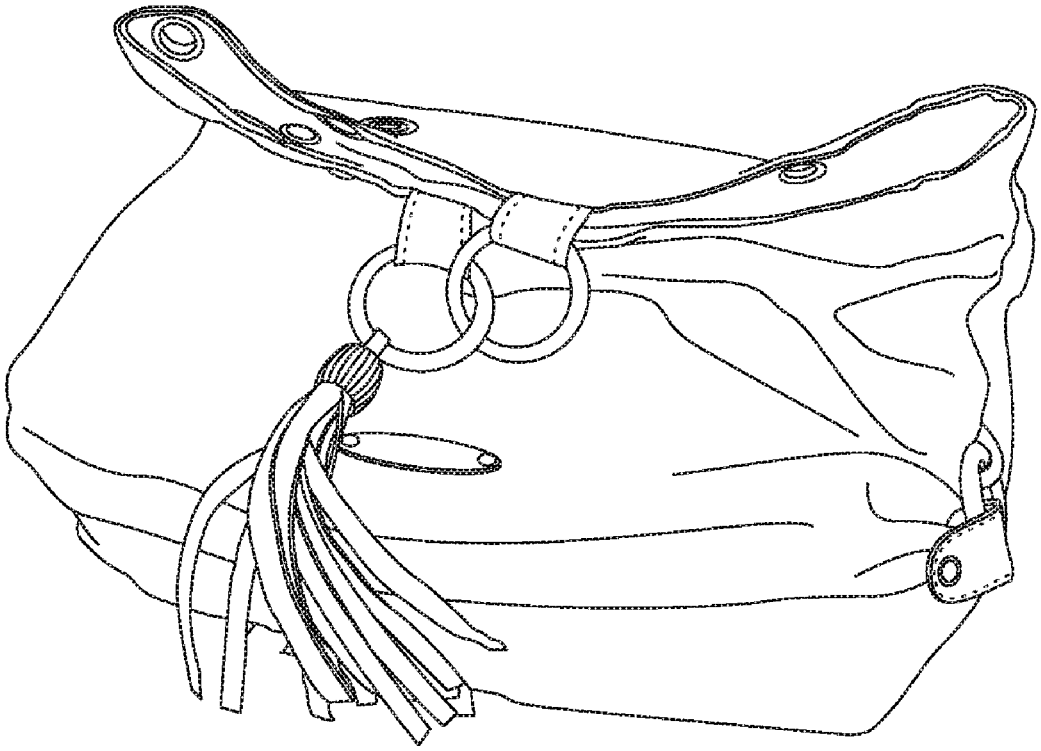
FIG. 51 is a front aspect view of the bag in FIG. 1, showing the fabric side and a tassel attached.

In these embodiments, the fully extended (usually leather) side with the box bottom and 4 metal feet measures 13" from the top of the bag to the box bottom edge (FIG. 50). The box bottom measures 3" wide and 10%"long. The top of the bag is straight across and flat in shape. When the bag is lying flat, it measures 15" from side seam to side seam. The two columns of, but not limited to, four grommets are spaced 7" apart measured from the center of the grommet boles. The grommets, eyelets (or similar devices) are vertically spaced 1%" from each other, measured from center to center. The grommet, eyelet (or similar device) closest to the top edge of the bag measures ⅛" from the top edge of the bag to the outer edge of the grommet, eyelet (or similar device). At both opposing top edges of the bag, a grommet, eyelet (or similar device) is installed at the same height as the top grommet, eyelet (or similar device) in the column row of, but not limited to, one. These two or more grommets are designed to have handles clipped to them to form additional bag looks such as the "hobo" (FIG. 19).

Also in these embodiments, the height of the bag will change as a user folds the bag to a lower position, ending at the lowest position (evening bag) (FIG. 33) with only the lowest of, but not limited to, the four grommets, eyelets (or similar devices) showing for handle attachment. This configuration measures 9" from the top of the bag to the box bottom seam edge when using four grommets of but not limited to, the typical #3 rolled rim type.

In this embodiment, when the handbag is fully reversed to its opposite side, the bottom design is now the rounded style with each end corner drawn up and held by a 2" ring attached to two small folded leather tabs, one located at the bottom corner of the bag, and an opposite matching tab located above the ring. The bottom has a center seam rather than a box bottom rectangular seam. Therefore the measurement from the top of the bag to the rounded bottom is approximately 14" depending on how the bag is sitting.

Another feature of this embodiment includes the interior removable zippered or pouched bag which measures approximately 10" long and 6" tall with a gusset bottom. This bag has an option for attaching a provided leather handle in a loop (FIG. 47) (wrist bag), clipping the handle to both sides for use as a small shoulder bag (FIG. 48), or clipping the bag to a grommet or handle snap hook on the bag.

Additionally, a "clutch" type bag may easily be formed by opening the bag to the full "tote" length position fabric view, or leather view, removing any detachable handles and then folding the bag approximately in half fabric side view showing grommets, and leather view showing grommets, and rear leather view non-grommet side. The handbag may now serve as yet another transformation, the popular "clutch" design, many times held under the arm.

The various embodiments of the handbags may be composed of fine leather, tapestry, and/or fabric that is completely reversible, with two different sides and bottoms (box bottom with feet on one side and rounded bottom with corner tabs and rings on the other), that can transform into several different styles by utilizing detachable handles that attach to strategically spaced grommets or other similar holding devices (installed on the bag) as the bag is reversed, folded, cuffed inward or outward, to expose one side of the bag or a combination of both sides, ultimately providing more than 17 different handbag looks, with one handbag.

One objective is to provide users with a single design, multi-functional handbag that can quickly and easily convert, reverse, and transform into several different handbags looks. In the past there have been changeable handbags, such as one attaching different side panels to a purse frame or two hinged flaps that flip over and change color. Embodiments are multifunctional reversible and transformable single bags which can change into more than 17 different styles, ranging from tote size to evening clutch, while combining fine quality leather with high quality tapestry or fabric on the reverse side.

Embodiments may be used in the following different ways. For example, embodiments may be used as a large sac/book bag/diaper bag/travel bag/animal carrier/computer bag/bottled water bag/grocery bag/knitting supplies/picnic supplies/backpack/front pack, they may be folded over with the soft tapestry or faux fur side on the outside: it can be used as an airplane pillow, lower back support pillow, elbow cushion, lower arm cushion and they may be folded to their smallest size. Other embodiments may be used as an emergency head covering hat and/or a hand warmer. In other embodiments, the 26" leather handles with clips can be used as an emergency tourniquet or a dog leash.

In general, embodiments can be assembled with or without the detachable leather handles, and use but not limited to, bamboo or chain handles instead. They may also be constructed:

With or without the detachable interior zippered or pouched bag; With or without bottom feet;

With fabric or leather on both sides;

With fewer or more grommets or different shaped grommets or just holes, rings, or similar devices;

With different kinds of hardware; and

With bottoms finished differently

Embodiments may include material including but not limited to: leather, fabric, or faux fur for body of bag. Metal grommets (or similar device), purse feet, gate rings (or similar spring-loaded round open/close device), tassel rings, snap hooks (or similar spring-loaded open/close device for handles), nameplate, and all other hardware. Leather or other material handles, interior pouch(es) of leather or fabric.

In several embodiments, the leather side of the bag is square with a center seam and boxed bottom. Fabric side is square with no center seam or box bottom. Corners are drawn up into leather tabs and rings to form bottom. Handles are shoulder-length, padded, usually leather, and are attached to a large trigger snap hook (or similar spring-loaded open/close device) at each end for attachment to the handbag. Large gate rings (rings or similar spring-loaded round devices that open and close) are suspended from the top edge of each side of the bag by leather (or other material) tabs. A long leather fringed tassel is formed with a metal cap, and can attach to any of the gate rings or snap books anywhere on the bag. The interior pouch or pouches can be clipped in with the snap hooks or attached to the bag by clipping elsewhere, and can be removed and used by themselves as a small bag.

Hardware used with the embodiments includes but is not limited to metal, usually nickel, gold, or antique brass in color. The metal gate rings (or other similar device) allow the attachment of tassels or ornaments and in some cases can be used to attach optional handles. They can be clasped together to close the top of the bag. The bag bottoms are formed to help the bag, when full, stand upright. The multiple grommets (or similar device to allow attachments) allow the folding necessary for the different style conversions, as does the reversibility. The removable handles also allow for the conversions, and are padded for comfort on the shoulder. The removable tassel is able to be attached wherever desired. Leather and fabric are chosen for durability and quality.

In many embodiments, the removable hardware and strategic grommet placement, as well as the unusual designs of the embodiments, allow the embodiments to function in these described fashions.

In several of the embodiments, several components work together. For example, the detachable handles, when used, are an integral part of several embodiments as they attach to the handbag provided levels of grommets, rings, holes or other similar handle attachment devices, as the user folds or unfolds the handbag to create different levels of handle attachments, thus creating different styles of handbags, and ways to use the handbag in the many variety of ways that may use handles.

The handles may include a spring-loaded clip at each end, allowing many optional bag attachment configurations, as well as, and including, attaching the handles together to form longer handles. When the handles are removed, the embodiments can be cuffed to outside at any of, but not limited to, three levels allowed by two columns of, but not limited to, four grommets, so that at any point where two grommets face each other, snap hook handles can be attached. In other embodiments, the same is true when the bag is cuffed to the inside (on either of its reversible sides).

Yet in other embodiments, a zippered pouch can be used inside or outside the bag at any side, conversion, or level; or removed and worn by itself with provided handle or strap. This functional item also provides security and extra storage.

In other embodiments, fabric side of the bag has tabs attached to the bottom corners which hold rings, which draw up corners to and are held by, but not limited to, another tab, thus forming a bottom to the fabric side of the bag.

Other embodiments include the use of a tassel or tassels which are made of leather and have top loop or other means of allowing its removal and placement on gate rings, snap hooks (or similar spring-loaded devices) or in handles, clips or rings or similar receptacles anywhere on the bag.

In several of the embodiments of the handbag, when in the fully extended height with all grommets or similar holding devices available on the sides and edges of the handbag, the handles may attach in a variety of ways to these provided devices to alter the look and style of the handbag. While the presently preferred embodiments of the invention have been disclosed, it will be apparent to those skilled in the art that various changes and modifications can be made herein without departing from the scope of the inventive subject matter.

I claim:

1. A reversible handbag, having removable handles comprising:

a front side and a back side, each of said sides having an outer surface, an inner surface, a first boundary, a second boundary, a top boundary, and a bottom boundary, each side being constructed of two material layers allowing the bag to be at least partially reversible, a seam joining the said two material layers forming said top boundary in each side;

a bottom side, said bottom side having and an outer surface, an inner surface and a perimeter;

a first side seam formed by joining said first boundary of said front side with said first boundary of said back side, a second side seam formed by joining said second boundary of said front side with said second boundary of said back side;

wherein said bottom boundary of said front side, said bottom boundary of said back side, a bottom edge of said first side seam, and a bottom edge of said second side seam are joined to said perimeter;

wherein said top boundary of said front side, said top boundary of said back side, form an open periphery;

wherein said first side seam and said second side seam each have a seam aperture located near said top edge of each said seam; and wherein said front side and said back side each have two columns of two or more surface apertures, said columns extending in a direction substantially perpendicular to said bottom boundary said handbag having a position wherein said open periphery of said handbag being folded inwards or outwards to alter the size and shape of said handbag, said columns of apertures being aligned to allow said handles to be connected there through.

2. The handbag according to claim 1, wherein each of said side seams has a loop disposed between said top edge and said bottom edge of said seams, a tab located near each said bottom edge of said seams, whereby a bottom corner of said handbag is drawn up by removably fastening said loop to said tab with a rigid ring received by said loop and said tab.

3. The handbag according to claim 1, wherein said top boundary of said front side and said back side each has a looped tab.

4. The handbag according to claim 3, wherein said looped tab is capable of removably retaining a rigid ring.

5. The handbag according to claim 4, wherein said ring removably receives a tassel.

6. The handbag according to claim 1, wherein said top boundary is wider than said bottom boundary.

7. The handbag according to claim 1, wherein said bottom side is substantially rectangular in shape.

8. The handbag according to claim 1, wherein said outer surface of said bottom side has a plurality of rigid feet.

9. The handbag according to claim 1, wherein said apertures are capable of removably retaining a clasp.

10. The handbag according to claim 9, wherein said clasp is disposed at each end of a strap.

11. The handbag according to claim 10, wherein said clasp is a spring loaded snap hook.

12. The handbag according to claim 1, wherein said outer surfaces of said front, back, and bottom sides and said inner surfaces of said front, back, and bottom sides comprise different materials.

13. The handbag according to claim 12, wherein said materials are selected from the group consisting of leather, fabric, faux fur and combinations thereof.

* * * * *